US006152805A

United States Patent [19]

Takahashi

[11] Patent Number: 6,152,805

[45] Date of Patent: Nov. 28, 2000

[54] POLISHING MACHINE

[75] Inventor: Kazuo Takahashi, Kawasaki, Japan

[73] Assignee: Canon Kabushiki Kaisha, Tokyo, Japan

[21] Appl. No.: 09/116,496

[22] Filed: Jul. 16, 1998

[30] Foreign Application Priority Data

Jul. 17, 1997 [JP] Japan ..... 9-192363
Jul. 28, 1997 [JP] Japan ..... 9-201441

[51] Int. Cl.[7] ..... B24B 1/00

[52] U.S. Cl. ..... 451/36; 451/41; 451/104

[58] Field of Search ..... 451/41, 36, 104, 451/106, 111, 113, 287

[56] References Cited

U.S. PATENT DOCUMENTS

| | | | |
|---|---|---|---|
| 4,209,947 | 7/1980 | Ohno | 51/7 |
| 4,789,424 | 12/1988 | Fornadel et al. | 156/637 |
| 4,821,466 | 4/1989 | Kato et al. | 51/317 |
| 5,040,336 | 8/1991 | Ahern | 51/7 |
| 5,088,238 | 2/1992 | Lin | 51/163.1 |
| 5,664,990 | 9/1997 | Adams et al. | 451/60 |
| 5,725,420 | 3/1998 | Torii | 451/285 |
| 5,817,245 | 10/1998 | Iwamoto et al. | 216/88 |

FOREIGN PATENT DOCUMENTS

| | | | |
|---|---|---|---|
| 363-185556 | 8/1988 | Japan | 451/113 |
| 402-256457 | 10/1990 | Japan | 451/113 |
| 722748 | 3/1980 | U.S.S.R. | 451/104 |

*Primary Examiner*—Timothy V. Eley
*Assistant Examiner*—Dung Van Nguyen
*Attorney, Agent, or Firm*—Fitzpatrick, Cella, Harper & Scinto

[57] ABSTRACT

The present invention provides a polishing machine in which the polishing face of the polishing pad is made to contact the polishing object face of the wafer with efficient supply of the polishing agent on the polishing object face of the processing object in the polishing process, the polishing object face of the wafer being polishing by allowing at least either one of them to rotate, wherein the wafer is polished by repeatedly making a contact and non-contact between the polishing pad and wafer during the polishing process in the polishing agent accommodated in the vessel.

91 Claims, 7 Drawing Sheets

POLISHING MACHINE

BACKGROUND OF THE INVENTION

1. Field of the Invention

The present invention relates to a polishing machine for polishing the surface of substrates such as wafers with high precision and a method thereof.

2. Description of the Related Art

As a result of advances in super-fine processing and the profileration of semiconductor devices in recent years, chemical and mechanical polishing (CMP) machines as processing means for polishing SOI substrates, semiconductor wafers comprising Si, GeAs or InP, wafers having an insulation film or a metal film on the surface in the production process of integrated semiconductor circuits and substrates for use in displays have been widely used.

Conventional CMP machines are described hereinafter referring to FIG. 8 and FIG. 9. FIG. 8 shows an example for polishing a wafer 1 using a polishing pad 2 comprising, for example, polyurethane having a larger diameter than the diameter of the wafer 1, wherein the wafer 1 as a polishing object is held with a wafer holder 3 by holding its polishing object face downward. This polishing pad 2 has an uneven or a porous surface. As shown in FIG. 9, the wafer 1 is rotated with a driving means (not shown in the drawing) along the direction indicated by an arrow. The polishing pad 2 is also rotated with a driving means (not shown in the drawing) along the direction indicated by an arrow. The polishing object face of the wafer 1 making contact with the polishing pad 2 is polished by a relative rotation between the wafer 1 and polishing pad 2 or by rotating either one of them. A polishing agent (slurry) is fed from a slurry feed means 5 for the purpose of improving the degree of polishing. The slurry is composed of, for example, an aqueous alkaline solution in which fine particles of $SiO_2$, having a particle size on the order of a micron or sub-microns, are stably dispersed. The slurry is fed between the wafer 1 and polishing pad 2 from outside.

FIG. 9 is an example where a polishing pad 2 having a smaller diameter than the diameter of the wafer 1 is held with a polishing pad holder 6 to polish the wafer 1 fixed by holding its polishing face upward.

The slurry is fed from a slurry feed means (not shown in the drawing) connected to a small hole 7 provided at the polishing pad to the gap between the wafer 1 and polishing pad 2 through a small hole 7.

However, there are problems in the conventional type CMP machines described above that a sufficient amount of slurry is not retained between the wafer 1 and polishing pad 2, because a centrifugal force is generated when the wafer 1 or the polishing pad 2, or both of them, is rotated, thereby pushing the slurry fed between the wafer 1 and polishing pad 2 outward.

The foregoing discussion will be described in more detail. In the conventional type CMP machines shown in FIG. 8, it is difficult for the slurry to penetrate into the gap between the rotating wafer 1 and polishing pad 2 since the slurry is fed between the wafer 1 and polishing pad 2 from outside. Although the slurry is fed through the small hole 7 to feed it between the wafer 1 and polishing pad 2 at the initial stage in the conventional type CMP machines shown in FIG. 9, the slurry is thrown out of the gap between the wafer 1 and polishing pad 2 by centrifugal force.

Consequently, polishing is carried out while insufficient amount of the slurry is not retained between the wafer 1 and polishing pad 2 in the conventional type CMP machines shown in FIG. 8 and FIG. 9. This results in a decrease of the degree of polishing. Accordingly, even when a fresh slurry is fed in order to maintain a high degree of polishing, the amount of the slurry retained between the wafer 1 and polishing pad 2 remains decreased, thereby hindering the degree of polishing. The remaining slurry tends to be localized between the wafer 1 and polishing pad 2, thereby resulting in an uneven polishing when polishing is continued under this condition.

While the polishing object face of the wafer 1 is kept wet by retaining a sufficient amount of the slurry on the surface of the wafer 1, the polishing object face of the wafer 1 is liable to be dry, on the contrary, when a sufficient amount of the slurry is not retained on the polishing object face of the wafer 1.

Consequently, the polishing debris created during polishing is unexpectedly absorbed on the polishing object face of the wafer 1. For example, the fine particulate components of the slurry, especially the fine particles comprising $SiO_2$ or Ce, are extremely liable to be absorbed on the wafer 1, and the fine particles once absorbed as described above are difficult to remove from the wafer 1.

The foregoing fine particles are coagulated by themselves or with the fine particles that are components of the slurry in a dry condition, forming large coagulation masses. The coagulation mass unexpectedly injures the wafer surface when polishing proceeds without removing the coagulation mass from the surface of the wafer 1.

A frictional heat would accompany polishing when a sufficient amount of the slurry is not retained between the wafer 1 and the pad 2. When the polishing object face of the wafer 1 involves semiconductor elements, the surface of the semiconductor elements experience a heat modification, causing deterioration of electric characteristics of the semiconductor device.

When the rotation speed of the wafer 1 or polishing pad 2 is increased in order to increase the degree of polishing or to improve productivity, larger centrifugal force is applied, consequently further reducing the amount of slurry between the wafer 1 and the polishing pad 2.

The unexpected frictional heat as hitherto described tends to also increase.

As hitherto described, a variety of unexpected phenomena are caused when a sufficient amount of the slurry is not retained between the wafer 1 and the polishing pad 2, thereby leading to a poor wafer quality.

When the polishing object face is a substrate for use in displays composed of a substrate for use in expensive highly integrated circuits such as a microprocessor or a thin film semiconductor, it is crucial to reduce the production cost to improve the yield of the substrate.

Much more slurry than necessary has been continuously fed during the polishing process in the conventional art for the purpose of solving the foregoing problems. However, this method imposes a large burden on the production cost.

Although conventional wafers have a diameter of 6 inches, the diameter of the wafer will be largely increased to 12 inches or more in the future. Consumption of the slurry increases with the enlargement of the wafer diameter, requiring reconsideration of new measures and methods for efficiently feeding the slurry.

A dust generated in the polishing process adheres again on the wafer to cause functional deterioration of the wafer. The dust scattered in the environment may also cause spreading of contamination all over the polishing machine or around the polishing machine, thereby requiring frequent a short term maintenance of the polishing machine or installation of the polishing machine in a clean environment. Therefore, efficient recovery of the generated dust is essential.

The object of the present invention is, based on the problems of the conventional art, to provide a measure or a method for retaining a sufficient amount of slurry between the wafer and polishing pad.

SUMMARY OF THE INVENTION

Accordingly, the object of the present invention is to provide a polishing machine having a holding means to hold an object to be processed, a polishing tool, a pressing means for allowing the polishing object face of the object to be processed to with contact with the polishing face of the polishing tool, both vertically confronting with each other, by applying a given pressure, and a driving means for allowing at least either one of the object to be processed or the polishing tool to rotate, wherein the polishing machine has a vessel for accommodating a polishing agent, and a reciprocating movement means for allowing at least either one of the object to be processed or the polishing tool to vertically reciprocate, the object to be processed and the polishing tool repeating a contact and non-contact with each other in the polishing agent accommodated in the vessel to polish the face of the object to be processed with the polishing tool.

The present invention also provides a polishing machine, wherein the vessel is composed of an alkali resistant material.

The present invention also provides a polishing machine, wherein the vessel is composed of an acid resistant material.

The present invention also provides a polishing machine, wherein the polishing tool is attached with its polishing face downward.

The present invention also provides a polishing machine, wherein the polishing tool is attached with the polishing face upward.

The present invention also provides a polishing machine, wherein the polishing tool polishes the entire face of the polishing object face of the object to be processed.

The present invention also provides a polishing machine, wherein the polishing tool polishes only a part of the polishing object face of the object to be processed.

The present invention also provides a polishing machine, wherein the polishing face of the polishing tool is larger than the polishing object face of the object to be processed.

The present invention also provides a polishing machine, wherein the face of the object to be processed has an approximately circular shape.

The present invention also provides a polishing machine, wherein the polishing object face of the object to be processed has an approximately circular shape and the ratio of the diameter of the polishing face of the polishing tool to the diameter of the polishing object face of the object to be processed is in the range of 1 or more and less than 2.

The present invention also provides a polishing machine, wherein the polishing face of the polishing tool is smaller than the polishing object face of the object to be processed.

The present invention also provides a polishing machine, wherein at least two polishing tools are provided.

The present invention also provides a polishing machine, wherein the driving means allows the polishing tool to rotate.

The present invention also provides a polishing machine, wherein the driving means allows the polishing tool to revolve.

The present invention also provides a polishing machine, wherein the driving means allows the holding means of the object to be processed to rotate.

The present invention also provides a polishing machine, wherein the driving means allows the holding means of the object to be processed to revolve.

The present invention also provides a polishing machine having a swinging means to swing the polishing tool.

The present invention also provides a polishing machine having a swinging means to swing the object to be processed.

The present invention also provides a polishing machine, wherein the means allows either one of the polishing tool or the object to be processed to stand still while reciprocating the other.

The present invention also provides a polishing machine, wherein the reciprocating movement means allows both of the polishing tool and the object to be processed to reciprocate.

The present invention also provides a polishing machine, wherein the reciprocating movement means has at least one pressure control means for either an elastic material or a fluid.

The present invention provides a polishing machine being electrically connected to the reciprocating movement means, imparting electric signals to the reciprocating movement means, and having a control means for arbitrarily setting the distance between the face of the object to be processed and the polishing face of the polishing tool in a non-contact state.

The present invention also provides a polishing machine being electrically connected to the pressing means, imparting electric signals to the pressing means, and having a control means for arbitrarily setting the pressure for allowing the polishing tool to contact the object to be processed.

The present invention also provides a polishing machine, wherein the polishing face of the polishing tool has a small hole for connecting to the feed means of the polishing agent.

The present invention also provides a polishing machine, wherein the polishing tool has a freely attachable and detachable polishing pad and a pad holder for holding the same.

The present invention also provides a polishing machine, wherein the polishing tool has a cavity for increasing buoyancy in the polishing agent.

The present invention also provides a polishing machine, wherein the polishing tool has a plurality of penetrating holes opening on the holding face to hold the polishing pad.

The present invention also provides a polishing method for polishing a face of an object to be processed by allowing at least either one of the object to be processed or a polishing tool to rotate and by allowing the face of the object to be processed to contact a polishing face of the polishing tool under a given pressure, wherein the face of the object to be processed is polished while repeating a contact and non-contact between the face of the object to be processed and the polishing face of the polishing tool in the polishing agent accommodated in the vessel.

The present invention also provides a polishing method, wherein the processing object is either one of a semiconductor substrate, an insulating substrate provided on the polishing object face or a semiconductor substrate provided with a polishing object layer.

The present invention also provides a polishing method, wherein the polishing agent is composed only of fine particles.

The present invention also provides a polishing method, wherein the fine particles contain at least one of either silicone oxide, aluminum oxide or manganese oxide.

The present invention also provides a polishing method, wherein the polishing agent is a liquid containing the fine particles.

The present invention also provides a polishing method wherein, after polishing the entire face of the face of the object to be processed followed by specifying a portion to be polished, only the specified portion is polished again.

The present invention also provides a polishing method, wherein the polishing tool has a cavity for increasing buoyancy in the polishing agent.

The present invention also provides a polishing method, wherein the polishing tool has a plurality of penetrating holes opening on the holding face of the polishing pad for holding the polishing pad.

The present invention also provides a polishing machine having a holding means for holding an object to be processed, a polishing tool, a pressing means for allowing the polishing object face of the object to be processed to contact the polishing face of the polishing tool, both vertically confronting with each other, by applying a given pressure, and a driving means for giving a rotatory motion to at least either one of the object to be processed or the polishing tool, wherein the pressing means has a means for varying the pressure with a given cycle, and the polishes tool polishing the face of the object to be processed by changing the pressure in a vessel accommodating the polishing agent.

The present invention also provides a polishing machine, wherein the polishing object face is composed of polyurethane.

The present invention also provides a polishing machine, wherein the polishing tool has a cavity for increasing buoyancy in the polishing agent.

The present invention also provides a polishing machine, wherein the polishing tool has a plurality of penetrating holes opening on the holding face for holding the polishing pad.

The present invention also provides a polishing method for polishing a face of an object to be processed by allowing at least either one of the object to be processed or a polishing tool to rotate and by allowing the face of the object to be processed to contact a polishing face of the polishing tool under a given pressure, wherein the face of the object to be processed is polished with the polishing tool by varying the pressure with a given cycle in the polishing agent accommodated in the vessel.

The present invention also provides a polishing method, wherein polyurethane is used for the polishing face.

The present invention also provides a polishing method, wherein the polishing tool has a cavity for increasing buoyancy in the polishing agent.

The present invention also provides a polishing machine, wherein the polishing tool has a plurality of penetrating holes opening on a holding face for holding a polishing pad.

The present invention also provides a polishing machine having a holding means to hold an object to be processed, a polishing tool having holes at a polishing face side, a pressing means for allowing a face of the object to be processed to contact the polishing face of the polishing tool, both vertically confronting with each other, by applying a given pressure, a driving means for giving a rotatory motion to at least either one of the object to be processed or the polishing tool, a vessel for accommodating a polishing agent, and a means for allowing at least one of either the processing object or the polishing tool to vertically reciprocate, wherein the polishing machine has a polishing agent suction means connected to the hole, the polishing agent suction means suctioning the polishing agent through the hole.

The present invention also provides a polishing machine, wherein the polishing agent suction means is connected to a polishing agent recycle means.

The present invention also provides a polishing machine, wherein the vessel is composed of an alkali resistant material.

The present invention also provides a polishing machine, wherein the vessel is composed of an acid resistant material.

The present invention also provides a polishing machine, wherein the polishing tool is attached with the polishing face downward.

The present invention also provides a polishing machine, wherein the polishing tool is attached with the polishing face upward.

The present invention also provides a polishing machine, wherein the polishing tool polishes an entire face of the face of the object to be processed.

The present invention also provides a polishing machine, wherein the polishing tool polishes only a part of the face of the object to be processed.

The present invention also provides a polishing machine, wherein the polishing face of the polishing tool is larger than the face of the object to be processed.

The present invention also provides a polishing machine, wherein the face of the object to be processed has an approximately circular shape.

The present invention also provides a polishing machine, wherein the face of the object to be processed has an approximately circular shape and the ratio of the diameter of the polishing face of the polishing tool to the diameter of the face of the object to be processed is in the range of 1 or more and less than 2.

The present invention also provides a polishing machine, wherein the polishing face of the polishing tool is smaller than the face of the object to be processed.

The present invention also provides a polishing machine, wherein at least two polishing tools are provided.

The present invention also provides a polishing machine, wherein the driving means allows the polishing tool to rotate.

The present invention also provides a polishing machine, wherein the driving means allows the polishing tool to revolve.

The present invention also provides a polishing machine, wherein the driving means allows the holding means to rotate.

The present invention also provides a polishing machine, wherein the driving means allows the holding means of the object to be processed to revolve.

The present invention also provides a polishing machine having a swinging means to swing the polishing tool.

The present invention also provides a polishing machine having a swinging means to swing the object to be processed.

The present invention also provides a polishing machine, wherein the means allows either one of the polishing tool or the object to be processed to stand still while reciprocating the other.

The present invention also provides a polishing machine, wherein the means allows both of the polishing tool and the object to be processed to reciprocate.

The present invention also provides a polishing machine, wherein the means has at least one of pressure control means for either an elastic material or a fluid.

The present invention also provides a polishing machine being electrically connected to the means, imparting electric signals to the means, and having a control means for arbitrarily setting the distance between the face of the object to be processed and the polishing face of the polishing tool in a non-contact state.

The present invention also provides a polishing machine being electrically connected to the pressing means, imparting electric signals to the pressing means, and having a control means for arbitrarily setting the pressure for allowing the polishing tool to contact the object to be processed.

The present invention also provides a polishing machine, wherein the polishing tool has a freely attachable and detachable polishing pad and a pad holder for holding the same.

The present invention also provides a polishing machine, wherein the processing object and the polishing tool repeat a contact and non-contact with each other in the polishing agent accommodated in the vessel to polish the face of the object to be processed with the polishing tool.

The present invention also provides a polishing machine, wherein the polishing tool has a cavity for increasing buoyancy in the polishing agent.

The present invention also provides a polishing machine, wherein the polishing tool has a plurality of penetrating holes opening on a holding face for holding a polishing pad.

The present invention also provides a polishing method for polishing the face of said object to be processed by allowing at least one of either the object to be processed or a polishing tool having a hole at a polishing face side to rotate and by allowing the face of the object to be processed to contact the polishing face of the polishing tool under a given pressure, wherein the face of the object to be processed is polished with the polishing face of the polishing tool in a polishing agent accommodated in a vessel while suctioning the polishing agent through the hole by the polishing agent suction means.

The present invention also provides a polishing method, wherein the suctioned polishing agent is recycled and accommodated in the vessel after recovering its polishing ability for polishing the polishing object face of the object to be processed.

The present invention also provides a polishing method, wherein the processing object is any one of either a semiconductor substrate, an insulating substrate provided on the surface of the polishing object layer or a semiconductor substrate provided on the surface of the polishing object layer .

The present invention also provides a polishing method, wherein the polishing agent is composed only of fine particles.

The present invention also provides a polishing method, wherein the fine particles contain at least one of either silicone oxide, aluminum oxide or manganese oxide.

The present invention also provides a polishing method, wherein the polishing agent is a liquid containing the fine particles.

The present invention also provides a polishing method, wherein, after polishing an entire face of the face of the object to be processed followed by specifying a portion to be polished, only the specified portion is polished again.

The present invention also provides a polishing method, wherein the object to be processed and the polishing tool repeat a contact and non-contact with each other in the polishing agent accommodated in the vessel to polish the face of the object to be processed with the polishing tool.

The present invention also provides a polishing method, wherein the polishing tool has a cavity for increasing buoyancy in the polishing agent.

The present invention also provides a polishing method, wherein the polishing tool has a plurality of penetrating holes opening on a holding face for holding a polishing pad.

The present invention also provides a polishing machine having a holding means to hold an object to be processed, a polishing tool having a hole at a polishing face side, a pressing means for allowing a face of the object to be processed to contact a polishing face of the polishing tool by vertically confronting them under a given pressure, and a driving means for allowing at least one of either the object to be processed or the polishing tool to rotate, the pressing tool having a means for changing the pressure with a given cycle, wherein the machine has a polishing agent discharge means connecting to the hole while changing the pressure, the face of the object to be processed being polished with the polishing face of the polishing tool in a polishing agent accommodated in a vessel while suctioning the polishing agent through the hole by the polishing agent suction means.

The present invention also provides a polishing machine, wherein the polishing agent suction means is connected to the polishing agent recycle means.

The present invention also provides a polishing machine, wherein the polishing face is composed of polyurethane.

The present invention also provides a polishing machine, wherein the polishing tool has a cavity for increasing buoyancy in the polishing agent.

The present invention also provides a polishing machine, wherein the polishing tool has a plurality of penetrating holes opening on a holding face for holding a polishing pad.

The present invention provides a polishing method for polishing a face of an object to be processed by allowing at least one of either the object to be processed or a polishing tool having a hole on the polishing face to rotate and by allowing the face of the object to be processed to with contact with the polishing face of the polishing tool under a given pressure, wherein the pressure is changed with a given cycle and the face of the object to be processed is polished with the polishing face of the polishing tool in a polishing agent accommodated in a vessel while suctioning the polishing agent through the hole by the polishing agent suction means.

The present invention provides a polishing method, wherein the suctioned polishing agent is recycled and accommodated in the vessel after recovering its polishing ability for polishing the polishing object face of the object to be processed.

The present invention provides a polishing method, wherein polyurethane is used for the polishing face.

The present invention provides a polishing method, wherein the polishing tool has a cavity for increasing buoyancy in the polishing agent.

The present invention provides a polishing method, wherein the polishing tool has a plurality of penetrating holes opening on a holding face for holding a polishing pad.

According to the present invention, the gap between the object to be processed and the polishing tool can be repeatedly made narrow or wide in the polishing agent accommodated in the vessel during the processing process. In other words, the polishing agent easily penetrates into the gap; consequently, a sufficient amount of the polishing agent is constantly supplied on the polishing object face of the object to be processed. Similarly, a stable feed of a sufficient amount of the polishing agent is made possible by reducing the pressure for making a contact between the object to be processed and the polishing tool. A local temperature increase of the object to be processed due to frictional heat during polishing can be prevented by the heat capacity of the polishing agent itself, along with preventing the polishing debris generated during the polishing process from being scattered in the air by being trapped in the polishing agent.

According to the present invention, the polishing debris generated during the polishing process is prevented from being diffused in the vessel by suctioning the polishing agent into and sucking it from the hole provided at the polishing tool. Suctioning the polishing agent in the vessel allows the agent to penetrate into the gap between the object to be processed and the polishing tool, thereby constantly feeding a sufficient amount of the polishing agent on the polishing object face of the processing object. The polishing debris can be also efficiently recovered. A local temperature increase of the object to be processed due to frictional heat during polishing can be prevented by the heat capacity of the polishing agent itself, along with preventing the polishing debris generated during the polishing process from being scattered in the air by being trapped in the polishing agent.

DESCRIPTION OF THE PREFERRED EMBODIMENT

Figure 1A:
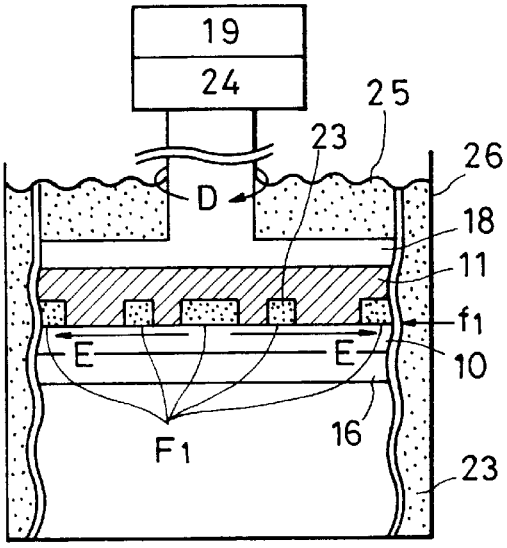
FIG. 1 is an illustrative drawing for describing the first embodiment of the present invention.
Figure 1A:
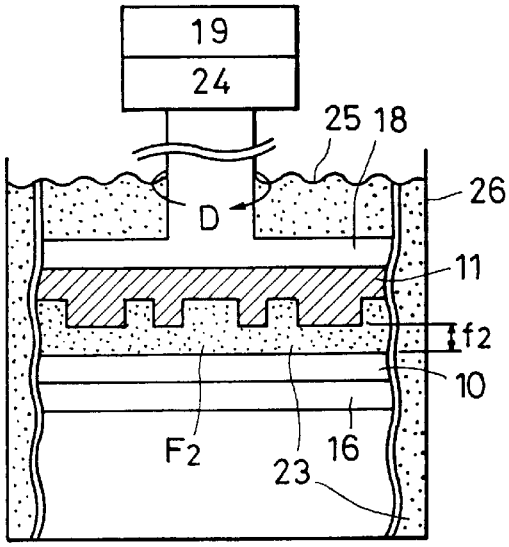
Figure 1A:
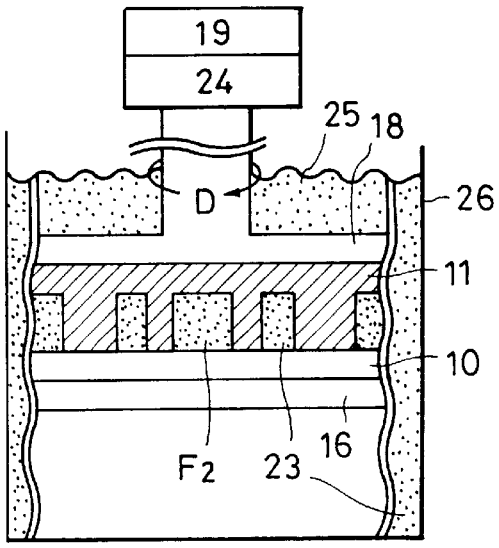
Figure 1C:
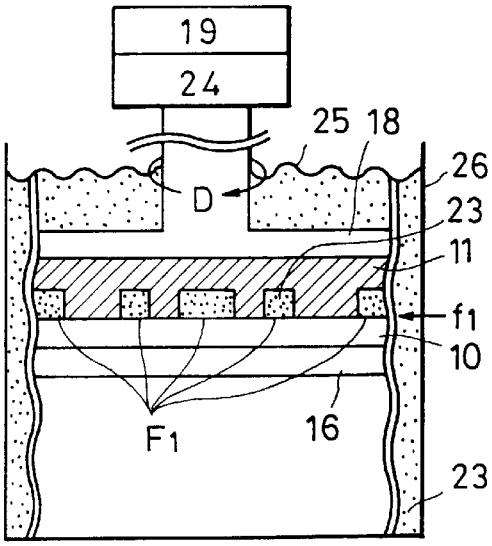

The embodiments according to the present invention will be described hereinafter.

First Embodiment

As shown by the reference marks a to c in FIG. 1, an object to be processed (a wafer 10) held by a holding means (a wafer chuck 16) confronts a polishing pad 11 having an uneven polishing face, held by a polishing tool (a polishing pad holder 18 having a freely attachable and detachable polishing pad 11) having a driving means 24, wherein the polishing pad 11 and the wafer 10 are driven by a means (a reciprocating movement means 19) that allows the space f1 and f2 between the wafer 10 and polishing pad 11 to be changed in the order shown by a, b1 and c under the liquid surface of the polishing agent (a slurry 23) in the first embodiment according to the present invention. The slurry 23 defined in the first embodiment according to the present invention is a liquid in which particles are dispersed. Both the polishing pad 11 and wafer 10 are provided in a vessel 26 in which the slurry 23 is accommodated. The reference mark a shows the state when the polishing pad 11 makes contact with the wafer 10 under the liquid surface 25 of the slurry 23, polishing the wafer 10 by rotating along an arrow D around the central axis of the polishing pad 11. The reciprocating movement means 19 also functions as a pressing means for endowing a given pressure when the wafer 10 makes contact with the polishing pad 11. The slurry 23 is retained in the gap F1 between the wafer 10 and a concave portion of the polishing pad 11 since the polishing pad 11 makes contact with the wafer 10 via the slurry 23 as shown in FIG. 1. The slurry 23 retained in F1 penetrates into the portion where the polishing object face of the wafer 10 substantially makes contact with the convex portion of the polishing face of the polishing pad 11. The reference mark f1 is a space of the forgoing portion where the polishing object face of the wafer 10 makes substantial contact with the polishing face of the polishing pad 11, the space being substantially zero. When the polishing pad 11 is rotated, the slurry is transferred from the center of rotation of the polishing pad 11 to outside with the elapse of course polishing time course in the space between the wafer 10 and the polishing pad 11 as shown by an arrow E, thereby causing a localization that makes the slurry 23 in the vicinity of the rotation center of the polishing pad 11 sparse while making the slurry 23 near the periphery of the polishing pad dense. Uneven polishing or unexpected injury would occur as described above when the polishing is continued for a long time under the condition shown by a. Accordingly, polishing is proceeded to the next step prior to the occurrence of the foregoing problems. The reference mark b1 denotes the conditions of the wafer 10 and the polishing pad 11 at that time.

The reference mark b1 shows the state when the space f2 between the wafer 10 and the polishing pad 11 becomes larger than the space f1 by allowing the polishing pad 11 to vertically travel under the liquid surface 25 of the slurry 23 by the reciprocating movement means 19 and when the slurry 23 is fed into the space f2 between the wafer 10 and the polishing pad 11. The wafer 10 remains in non-contact with the polishing pad 11 in all areas. The space f2 between the wafer 10 and the polishing pad 11 is immediately filled with the slurry 23 flowing from its periphery. The polishing pad 11 is kept rotating as in the state shown by the reference mark a.

The reference mark c represents the state when the wafer 10 makes contact with the polishing pad 11 by the reciprocating movement means 19 to start polishing again under the liquid surface 25 of the slurry 23 as shown by the reference mark b1. The slurry 23 is uniformly distributed in the space F1 between the wafer 10 and the polishing pad 11 without being localized, polishing the wafer 10 again. After proceeding with polishing, the slurry 23 is again localized between the wafer 10 and the polishing pad 11 as shown by the reference mark a, repeating a series of the states to return to the state shown by b1 after a given time lapse followed by the state shown by c. In the first embodiment according to the present invention, it is preferable that the wafer 10 and the polishing pad 11 are in the state shown by b1, or the wafer 10 makes no contact with the polishing pad 11 for the purpose that the slurry 23 is immediately filled into the space F2 between the wafer 10 and the polishing pad 11. When a material having a high elastic modulus is used for the polishing pad 11, the slurry 23 is rapidly fed between the wafer 10 and the concave portion of the polishing pad 11 by making partial contact between the wafer 10 and the polishing pad 11 instead of allowing the former to make full contact with the latter. Accordingly, a sufficient amount of the slurry 23 can be fed on the entire polishing object face of the wafer 10 by repeatedly increasing and decreasing the thickness of the polishing pad 11 by changing the pressure as shown in b2 instead of the state shown by b1.

While the polishing pad 11 and the wafer 10 are set to be positioned below the liquid surface 25 of the slurry 23 in any case of making non-contact or contact between them as described in the first embodiment in the present invention, the height of the liquid surface 25 of the slurry 23 can be freely determined by the quantity of the slurry 23 accommodated in the vessel (not shown in the drawing) or by setting the travel distance of the polishing head 11 along the vertical direction. For example, it is possible to set the liquid surface 25 of the slurry 23 to be positioned between the polishing pad 11 and the wafer 10, if necessary, when the polishing pad 11 makes no contact with the wafer 10.

A construction for allowing the polishing pad holder 18 having the polishing pad 11 to drive can be used as the driving means 24 and the reciprocating movement means 19 as described in the first embodiment in the present invention. However, the wafer chuck 16 for holding the wafer 10 may be rotated while vertically reciprocating, or both of the polishing pad holder 18 and the wafer chuck 16 may be rotated while vertically reciprocating.

The reciprocating movement means may be a fluid pressure control means comprising a hydraulic or pneumatic cylinder or a rigid elastic material such as a spring may be used.

It is preferable that the setting position of the reciprocating movement means 19 is determined at the polishing pad holder 18 to rotate together with the polishing pad holder 18 by the third driving means 14, provided that the reciprocating movement means 19 does not create a burdensome large load on the third driving means 14.

While a construction to allow the foregoing rotatory motion can be utilized for moving the polishing pad 11 along the horizontal direction as described in the first embodiment of the present invention, a revolving motion that rotates around a different axis from the rotation axis of the rotatory motion or a swinging motion (vibration motion) along the horizontal direction can be also used. Attaching a driving mechanism on the wafer holder 17 also allows the foregoing motions. The centers of the confronting wafer 10 and polishing pad 11 may not be necessarily aligned but they may be rotated while their axes are eccentric with each other.

The wafer 10 and the polishing pad 11 may be disposed so that the polishing object face of the former is directed downward while the polishing face of latter is directed upward in the present invention, provided that at least one of either the wafer 10 or the polishing pad 11 is always placed in the liquid of the slurry 23.

A guide ring or a vacuum chuck that allows the back face of the wafer 10 to be adhered to the wafer chuck 16 using a vacuum device may be used in the present invention. It is also preferable to fix the back face of the wafer to the wafer chuck 16 via a packing material using a material with a high frictional coefficient, wax or pure water.

With respect to the relative size of the wafer 10 and the polishing pad 11, the former may be larger or smaller than the latter in the present invention. However, the results of the detailed investigation on the relative size between the wafer 10 and the polishing pad 11 performed by the inventors of the present invention showed that it is preferable that the shapes of both of the wafer 10 and the polishing pad 11 are approximately circular and the polishing pad 11 has a larger diameter relative to the wafer 10. More preferably, the ratio of the diameters of the wafer 10 to the diameter of the polishing pad 11 is 1 or more and less than 2. When the sum total of the distance between the center axis of the wafer 10 and the center axis of the polishing pad 11 and the radius of the wafer 10 is smaller than the radius of the polishing pad 11 and the polishing pad 11 makes contact with the wafer 10, it is preferable for evenly polishing the entire surface of the wafer 10 that the polishing pad 11 always makes contact with the wafer 10.

When the diameter ratio as described above is less than 1, or the diameter of the polishing pad 11 is smaller than the diameter of the wafer 10, polishing of the entire surface is made possible when the wafer 10 is polished while allowing the polishing pad 11 to travel toward the entire polishing object face of the wafer 10 or a plurality of polishing pads 11 are used so as to cover the entire polishing object face of the wafer 10. Since the polishing pad 11 having a smaller diameter can select and polish only a localized portion of the entire face of the wafer 10, it can be applied for corrective polishing of the wafer that has been once polished.

The polishing pad 11 is made of, for example, polyurethane, which may be a polyurethane foam, a porous polyurethane or a high density and highly rigid polyurethane. Alternatively the polishing pad 11 may be made of Teflon.

The polishing agent to be used in the present invention may be composed merely of fine particles of, for example, silica ($SiO_2$), alumina ($Al_2O_3$), manganese oxide ($Mn_2O_3$ or $MnO_2$) or cerium oxide (CeO), or may be a dispersion prepared by dispersing the foregoing fine particles in an aqueous solution containing sodium hydroxide (NaOH), potassium hydroxide (KOH) or hydrogen peroxide ($H_2O_2$). For example, it is more preferable to use a slurry prepared by dispersing fine particles of $SiO_2$ or CeO when the constituting element of the polishing object is Si, or a slurry prepared by dispersing fine particles of $Al_2O_3$ or $Mn_2O_3$ when the constituting elements of the polishing object are metals such as Al, Cu or W. The particle diameter of the fine particles is about 8 nm to 50 nm, a relatively uniform particle size distribution being more preferable. When the liquid component of the slurry is alkaline or acidic, it is preferable to use a vessel 26 the surface of which is resistant to chemicals by processing its surface with, for example, Teflon.

Especially, when manganese oxide is used for the polishing fine particles, it is not necessary to disperse the fine particles of manganese oxide into a liquid. Instead, the powder is directly fed between wafer 10 and the polishing pad 11 disposed in the liquid for polishing.

Examples of the processing object to be polished according to the present invention include a SOI substrate having an approximately circular shape, a semiconductor wafer comprising Si, GeAs or InP, a wafer having an insulation film or a metal film in the processing of semiconductor integrated circuits or a substrate for use in displays with a rectangular shape having a polishing object layer on the surface.

Second Embodiment

Figure 2:
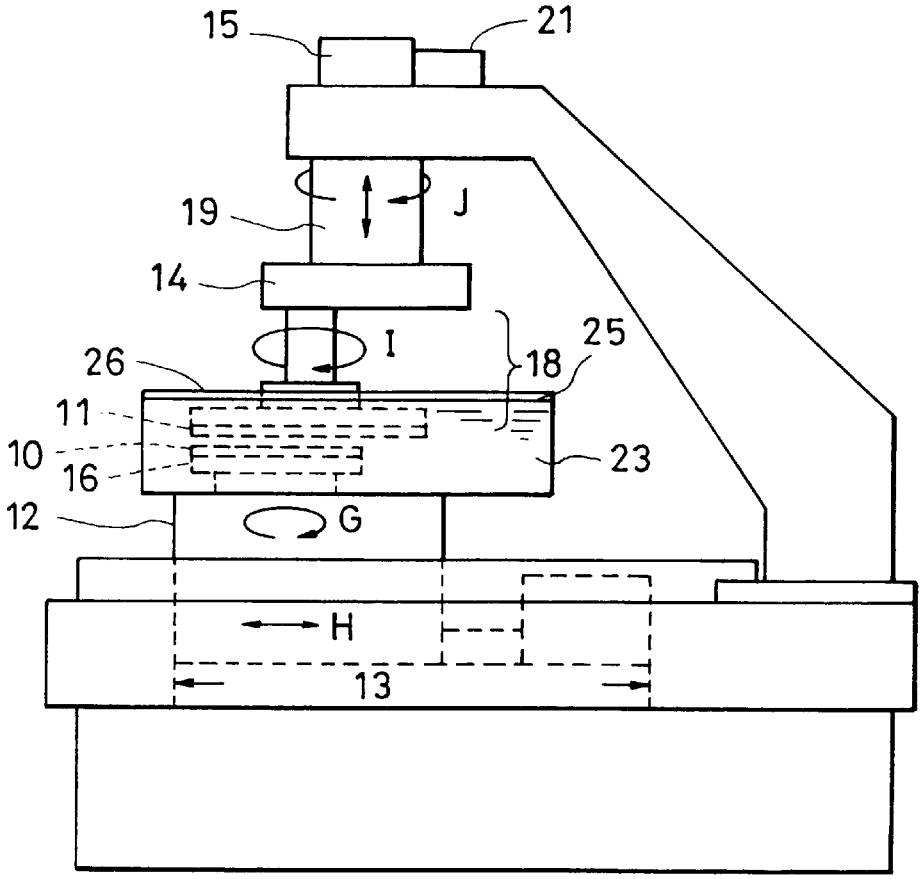
FIG. 2 is an illustrative drawing for describing the second embodiment of the present invention.

The CMP machine according to the second embodiment is shown in FIG. 2. This machine has a wafer holder 17 having a wafer chuck 16 for holding the wafer 10 by placing its polishing object face upward, a first driving means 12 for allowing the wafer 10 to rotate, a second driving means 13 composed of a guide and power supply for allowing the wafer 10 to vibrate, a third and fourth driving means 14 and 15 for allowing the polishing pad 11 to rotate, a reciprocating movement means 19 for allowing the polishing pad 11 to vertically move while allowing the polishing pad 11 to make contact with the wafer 10, a control device 21 for controlling the pressure applied when the reciprocating movement means 19 makes the polishing pad 11 press-contact with the wafer 10 and for controlling the travel distance of the polishing pad 11, a polishing pad holder 18 for holding the polishing pad 11 having a diameter larger than the diameter of the wafer 10 and to confront the polishing object face of the wafer 10, and a vessel 26 for accommodating the slurry.

The wafer chuck 16 for holding the wafer 10 is rotated along the direction indicated by an arrow G by the first driving means 12 and is vibrated along the direction indicated by an arrow H by the second driving means 13. The reciprocating movement means 19 electrically connected to the control device 21 allows the polishing pad holder 18 having a freely attachable and detachable polishing pad 11 to vertically reciprocate, the polishing pad 11 repeating a contact and non-contact with the wafer 10. The polishing pad 11 makes contact with the wafer 10 under an arbitrary pressure previously stored by the control device 21, repeatedly making a contact and non-contact with an arbitrary time interval previously stored in the control device 21 as described in the first embodiment. The control device 21 can also control the distance between the wafer 10 and the polishing pad 11 in the non-contact period. The third driving means 14 allows the polishing pad 11 to rotate along the direction indicated by an arrow I. The slurry 23 is accommodated in the vessel 26. The polishing pad 11 and the wafer 10 are positioned in the liquid of the slurry 23.

The fourth driving means 15 allows the polishing pad 11 to revolve along the direction indicated by an arrow J. As described above, the polishing pad 11 is made to rotate and to revolve by allowing the polishing pad 11 to rotate around the two different rotation axes.

Since a sufficient amount of the slurry is efficiently fed in the total area between the wafer 10 and the polishing pad 11, when the wafer 10 and the polishing pad 11 repeat contact and non-contact with each other, the wafer 10 can be polished without being injured while keeping a sufficient polishing rate in a given time interval.

The rotatory directions of the wafer 10 and the polishing pad 11 by the driving means 12, 14 and 15 are not necessarily along the directions indicated by the arrows but may be along respective arbitrary directions. This means that it is preferable to reverse the rotatory and revolving directions of the polishing pad 11 with each other. The cases when the rotatory and revolving directions of the polishing pad 11 are reversed with each other without rotating the wafer 10, or when the wafer 10 rotating along the same direction as the polishing pad 11 is polished while allowing the polishing pad 11 merely to rotate are also preferable. The driving means required for the rotation described above among the first, third and fourth driving means may be equipped in the polishing machine. The rotation speed, which can be selected within a range of several rpm to several tens of thousands rpm, may be also arbitrarily determined. It was found in the detailed studies by the inventors of the present invention that it is more preferable for making the polishing object face of the wafer flatter to rotate the wafer 10 and the polishing pad 11 along the same direction with a same rotation speed by the first, third and fourth driving means 12, 14 and 15. It is especially preferable that the rotation speed of the wafer 10 is made to be the same as that of the polishing pad 11. It is also preferable that the rotatory and revolving speeds of the wafer 10 are the same as each other. It was also found that the phenomenon that the wafer 10 is adhered on the polishing pad 11 in removing the former from the latter can be reduced when the rotation speed is increased above a given rotation speed, which is, for example, about 10 rpm or more.

The vertical reciprocating motion of the polishing pad 11 will be described by the actual examples. Suppose the time interval required for polishing the wafer 10 is 1 minute, then the polishing pad experiences several instances of non-contact with the wafer 10 within 1 minute. The difference of the time intervals between the times when the polishing pad 11 makes contact and non-contact with the wafer 10, or the difference between t2 and t1, is several seconds, being a time interval required for a sufficient amount of the slurry to be fed to the entire polishing object face of the wafer 10. The distance f2 between the wafer 10 and the polishing pad 11 in the non-contact state corresponds to a distance that does not make the rotating wafer 10 jump out during the non-contact time interval, a distance being smaller than the thickness of the wafer 10 or, for example, 0.2 to 0.8 mm.

The cycle of the vertical motion of the polishing pad 11 and the distance between the wafer 10 and the polishing pad are preferably set to achieve the degree of polishing within the objective values. The function for sufficiently distributing the slurry can be largely displayed by shortening the cycle of the vertical motion of the polishing pad 11 or by extending the travel distance of the polishing pad 11. After specifying the portion to be polished again in the polishing object face of the processing object that has been once polished, the polishing method according to the present invention can be also used for corrective polishing to polish the specified portion. When the polishing pad is composed of a material having a large elastic modulus, a sufficient amount of the slurry can be distributed in the space between the wafer 10 and the polishing pad 11 even if the entire area of the wafer 10 is not always in non-contact with the polishing pad 11 in the polishing process as described above. Otherwise, the same function and effect as described above can be expected by repeatedly increasing and decreasing the pressure when the polishing pad 11 makes contact with the wafer 10.

It is preferable that the polishing pad holder according to the present invention is constructed so as to be substantially buoyant.

Figure 3:
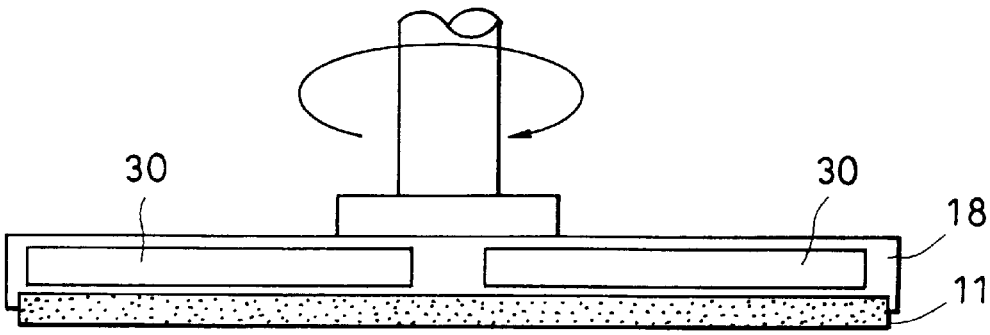
FIG. 3 is an illustrative drawing for describing the polishing pad holder according to the present invention.
Figure 4A:
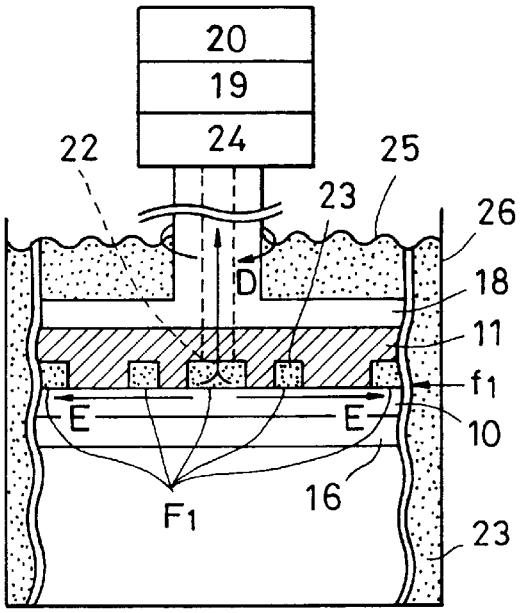
FIG. 4 is an illustrative drawing for describing the third embodiment of the present invention.
Figure 4A:
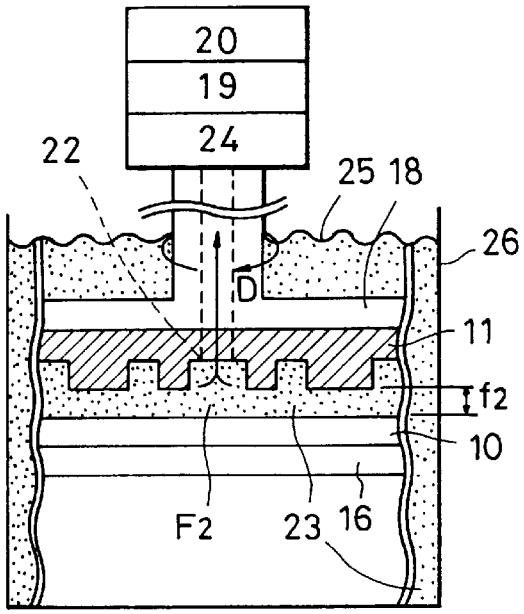
Figure 4A:
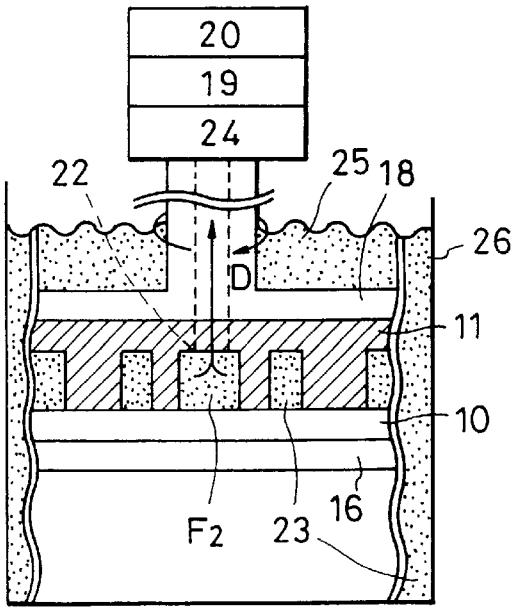
Figure 4C:
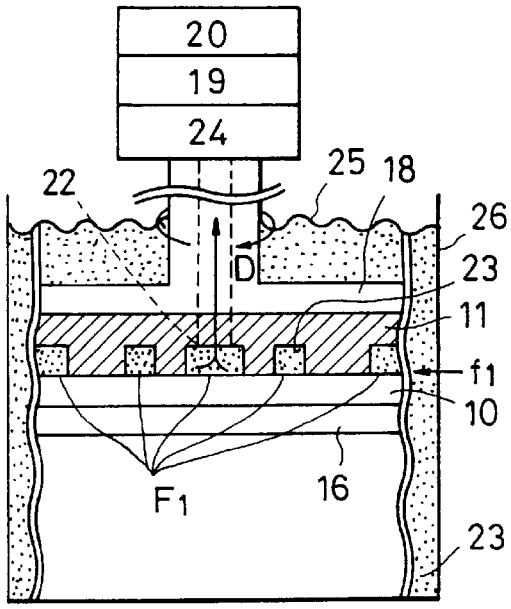

In more detail, a cavity 30 is provided in the interior of the polishing pad holder as shown in FIG. 3, accommodating a material having a large buoyancy.

Examples of the material having a large buoyancy are the materials with a small density such as woods, foamed resins or porous ceramics.

It is preferable that the polishing pad holder is so constructed as to keep the polishing pad flat while being able to rotate in high speed, wherein the material having a large buoyancy is surrounded with a rigid material such as a hard resin, thereby preventing the polishing pad holder from being deformed.

It is also preferable for making the construction of the polishing pad holder simple and for obtaining a large buoyancy that a cavity 30 is provided for accommodating a gas such as air, thereby increasing the substantial buoyancy of the polishing pad holder. Since the polishing pad holder is made to be lightweight in this case, the polishing pad holder can be readily rotated.

Increasing the substantial buoyancy of the polishing pad holder as described above allows the polishing pad making contact with the polishing object in the polishing process to be promptly and easily removed from the polishing object.

A high precision of vertical motion of the polishing pad is made possible by using a polishing pad holder with a high buoyancy together with a reciprocating movement means.

The reciprocating movement means enhances the pressure so that the polishing pad held by the polishing pad holder with a high buoyancy is made to contact the polishing object. The mechanism for allowing the polishing pad holder to shift along the vertical direction in the device constituting the reciprocating movement means is simplified by a construction in which the polishing pad holder can float by itself when the pressure once enhanced by the reciprocating movement means is diminished.

Third Embodiment

In the third embodiment of the present invention shown in the reference marks a to c of FIG. 4, the processing object (the wafer 10) held by the processing object holding means (the wafer chuck 16) confronts the polishing pad 11 having an uneven face on the polishing face, held by the polishing tool (the polishing pad holder 18 having a freely attachable and detachable polishing pad 11) having a small hole 22 connected to the slurry discharge (suction) means 20 having a driving means 24, and the polishing pad 11 and the wafer 10 are driven by a means (the reciprocating movement means 19) for changing the gaps f1 and f2 between the wafer 10 and the polishing pad 11 in the order shown by a, b1 and c under the liquid surface of the polishing agent (the slurry 23). The slurry 23 in the third embodiment of the present invention refers to a liquid in which particles are dispersed. Both of the polishing pad 11 and the wafer 10 are placed in a vessel 26 accommodated with the slurry 23. The slurry discharge means 20 comprises a suction pump for suctioning and discharging the slurry 23 through the small hole 22. The reference mark a shows the state when the polishing pad 11 makes contact with the wafer 10 under the liquid surface 25 of the slurry 23 and the polishing pad 11 polishes the wafer 10 by rotating along the direction indicated by an arrow D around the center axis of the polishing pad 11. The reciprocating movement means 19 also serves as a pressing means for imposing a given pressure when the wafer 10 makes contact with the polishing pad 11. As shown in FIG. 4, the slurry 23 is retained in the gap F1 between the wafer 10 and the concave portion of the polishing pad 11 because the polishing pad 11 makes contact with the wafer 10 via the slurry 23, the slurry 23 held by F1 penetrating into the portion where the polishing object face of the wafer 10 is substantially making contact with the concave part of the polishing face of the polishing pad 11. The reference mark f1 denotes a space of the foregoing portion where the polishing object face of the wafer 10 substantially makes contact with the concave portion of the polishing face of the polishing pad 11, the space being substantially zero. With rotation of the polishing pad 11, the slurry is transferred from the rotation center of the polishing pad 11 to outside between the wafer 10 and the polishing pad 11 as shown by an arrow E in the drawing as the time elapses, causing localization of the slurry 23 by which the slurry density in the vicinity of the rotation axis becomes sparse while making the density of the slurry at the periphery of the polishing pad dense. A long time period of polishing in the conditions shown by a may result in uneven polishing or unexpected injuries. Accordingly, the polishing process is proceeded to the next step prior to the occurrence of the problems described above, the state of the wafer 10 and the polishing pad 11 in the next step being shown in the drawing indicated by b1.

The drawing b1 shows the state when the space f2 between the wafer 10 and the polishing pad 11 becomes larger than the space f1 by allowing the reciprocating movement means 19 to shift the polishing pad 11 along the vertical direction under the liquid surface 25 of the slurry 23 and the state when the slurry 23 is fed to the space F2 between the wafer 10 and the polishing pad 11. The wafer 10 makes no contact with the polishing pad 11 over the entire region at the moment. The slurry discharge means 20 suctions and discharges the slurry 23 through the small hole 22, by which the space F2 between the wafer 10 and the polishing pad 11 is immediately filled with the slurry 23 flowing in from its circumference. The polishing pad 11 continues to rotate in the state as shown in a.

The reference mark c denotes the state when the wafer 10 again makes contact with the polishing pad 11 as indicated in b1 by the reciprocating movement means 19 under the liquid surface 25 of the slurry 23 to achieve polishing again. The slurry discharge means 20 suctions and discharges the slurry 23 through the small hole 22. The slurry 23 is uniformly distributed without being localized in the gap F1 between the wafer 10 and the polishing pad 11, whereby the wafer 10 is polished again. The slurry 23 is again localized in the gap between the wafer 10 and the polishing pad 11 as shown by a when polishing has been continued, returning to the state indicated by b1 with time followed by the state indicated by c to repeat a series of polishing conditions. By considering the purpose that the wafer 10 and the polishing pad 11 should be disposed so that the slurry 23 is promptly filled into the space between the wafer 10 and the polishing pad 11 in the first embodiment of the present invention, the state shown by b1, or the state when the wafer 10 makes no contact with the polishing pad 11, is more preferable. When a material having a high elastic modulus is used for the material of the polishing pad 11, the slurry 23 is promptly and uniformly fed into the space between the wafer 10 and the concave portion of the polishing pad 11 by allowing the wafer 10 to partially make contact with the polishing pad 11, not necessarily being in a perfectly non-contact state between them. Therefore, a sufficient amount of the slurry 23 can be fed to the entire polishing object face of the wafer 10 by repeatedly making the thickness of the polishing pad 11 thick and thin by changing the pressure as shown in b2. The slurry discharge means 20 also suctions and discharges the slurry 23 through the small hole 20 in the state shown by b2.

While the slurry discharge means 20 suctions and discharges the slurry 23 through the small hole 22 in any state when the polishing pad 11 makes no contact with the wafer 10, when in non-contact as shown in a, b2 and c, or when in c, as described in the third embodiment according to the present invention, the slurry discharge means 20 may suction and discharge the slurry 23 through the small hole 22 only in the state when the polishing pad 11 makes no contact with the wafer 10, or when in b1.

Although both of the polishing pad 11 and the wafer 10 are adjusted to be positioned under the liquid surface 25 of the slurry 23 in any case of making contact or non-contact as described in the third embodiment according to the present invention, the height of the liquid surface 25 of the slurry 23 can be arbitrarily determined by the amount of the slurry 23 accommodated in the vessel (not shown in the drawing) or by setting the travel distance along the vertical direction of the polishing head 11. For example, the liquid surface 25 of the slurry 23 can be adjusted so that it is positioned between the polishing pad 11 and the wafer 10, if necessary, when the polishing pad 11 makes no contact with the wafer 10.

While a construction for allowing the polishing pad holder 18 having the polishing pad 11 to drive as a driving means 24 and the reciprocating movement means 19 as described in the first embodiment according to the present invention, it will be no problem that the wafer chuck 16 holding the wafer 10 is allowed to rotate while reciprocating or that both of the polishing pad holder 18 and the wafer chuck 16 is allowed to rotate while reciprocating.

The reciprocating movement means 19 may be a fluid pressure control means comprising a hydraulic or pneumatic cylinder or a rigid elastic material comprising a spring may be used.

It is preferable to provide the setting position of the reciprocating movement means 19 at the polishing pad holder 18 to allow the means to rotate with a third driving means 14 together with the polishing pad holder 18, provided that the reciprocating movement means 19 does not create a burdensome large load on the third driving means 14.

While it is possible to use a construction by which the polishing pad 11 is allowed to rotate as described above to give a horizontal motion to it as described in the first embodiment according to the present invention, a revolving motion for allowing rotation around a different axis from the foregoing rotation axis or a swinging motion (vibration motion) along the horizontal direction can be used together. Each motion as described above may be induced by providing a driving means on the wafer holder 17. The wafer 10 and the polishing pad 11 may be rotated without aligning the center of them with each other but in an eccentric relation with each other.

The polishing object face of the wafer 10 may be directed downward while the polishing face of the polishing pad may be directed upward in the present invention provided that at least one of them always remains in the liquid of the slurry 23 during the polishing process.

A guide ring or a vacuum chuck by which the back face of the wafer 10 is adhered on the wafer chuck 16 using a vacuum device may be used for the fixing means of the wafer 10 in the present invention. It is also preferable to fix the back face of the wafer to the wafer chuck 16 via a packing material making use of a material with a high frictional coefficient, a wax or pure water.

Though the wafer 10 may be larger or smaller than the polishing pad 11 in the present invention, it was found to be suitable through the detailed studies on the dimensional relation between the wafer 10 and the polishing pad 11 by the inventors of the present invention that both of the wafer 10 and the polishing pad 11 have approximately circular shapes and the diameter of the polishing pad 11 is larger than the diameter of the wafer 10. More preferably, the ratio of the diameter of the polishing pad 11 to the diameter of the wafer 10 is 1 or more and less than 2. When the sum total of the distance between the center axis of the wafer 10 and the center axis of the polishing pad 11 and the radius of the wafer 10 is smaller than the radius of the polishing pad 11, and when the polishing pad 11 is making contact with the wafer 10, it is preferable that the polishing pad 11 always makes contact with the entire polishing object face of the wafer 10 for polishing the entire surface.

When the foregoing diameter ratio is less than 1, or when the diameter of the polishing pad 11 is smaller than the diameter of the wafer 10, a full surface polishing is made possible if polishing is carried out by moving the polishing pad 11 on the entire face of the polishing object face of wafer 10, or a plurality of the polishing pads 11 are used so that they cover the entire face of the polishing object face of the wafer 10. Since the polishing pad 11 having a smaller diameter can be used for selectively polishing a limited local portion of the total face of the wafer 10, it can be applied for corrective polishing of the wafer once polished.

The polishing pad 11 is made of, for example, polyurethane that may be a polyurethane foam, a porous polyurethane or a high density and highly rigid polyurethane. The polishing pad 11 may be composed of Teflon.

Examples of the polishing agent to be used in the present invention are dispersions prepared by dispersing only fine particles of silica ($SiO_2$), alumina ($Al_2O_3$), manganese oxide ($Mn_2O_3$ or $MnO_2$) or cerium oxide (CeO) in a liquid, or by dispersing the foregoing fine particles in a solution containing sodium hydroxide (NaOH), potassium hydroxide (KOH) or hydrogen peroxide ($H_2O_2$). For example, it is more preferable to use a slurry prepared by dispersing fine particles of $SiO_2$ or CeO when the constituting element of the polishing object is Si, or a slurry prepared by dispersing fine particles of $Al_2O_3$ or $Mn_2O_3$ when the constituting elements of the polishing object are metals such as Al, Cu or W. The particle diameter of the fine particles is about 8 nm to 50 nm, a relatively uniform particle size distribution being more preferable. When the liquid component of the slurry is alkaline or acidic, it is preferable to use a vessel 26 the surface of which is resistant to chemicals by treating its surface with, for example, Teflon.

Especially, when manganese oxide is used as polishing fine particles, it is not necessary to disperse manganese oxide in a liquid but it may be directly fed into the gap between the wafer 10 and the polishing pad 11 disposed in the liquid for polishing.

Examples of the processing object to be polished by the present invention are, for example, a SOI substrate having an approximately circular shape, a semiconductor wafer comprising Si, GeAs or InP, a wafer having an insulating film or metal film during the production process of semiconductor integrated circuits, or a substrate for use in rectangular displays having a polishing object layer on the surface.

Fourth Embodiment

Figure 5:
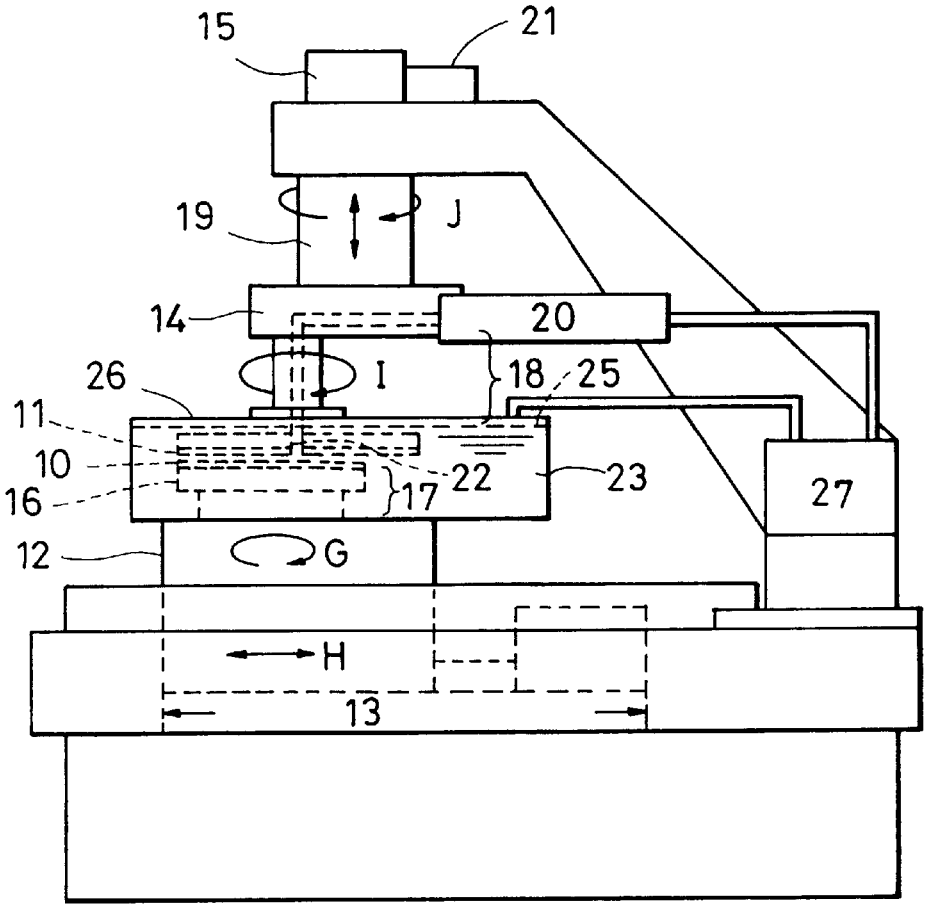
FIG. 5 is an illustrative drawing for describing the fourth embodiment of the present invention.

The CMP machine according to the fourth embodiment is shown in FIG. 5. This machine has a wafer holder 17 having a wafer chuck 16 for holding the wafer 10 with its polishing object face upward, a first driving means 12 for allowing the wafer 10 to rotate, a second driving means 13 composed of a guide and power supply for allowing the wafer to vibrate, a third or fourth driving means 14 or 15 for rotating the polishing pad 11, a reciprocating movement means 19 for allowing the polishing pad 11 to vertically travel and to press-contact with the wafer 10, a control device 21 for controlling the pressure when the reciprocating movement means 19 allows the polishing pad 11 to make contact with the wafer 10 and the travel distance of the polishing pad 11, a polishing pad holder 18 for holding the polishing pad 11, having a diameter larger than or twice or less of the diameter of the wafer 10, so as to confront the polishing object face of the wafer 10, a vessel 26 for accommodating the slurry, a slurry discharge means 20 connected to a small hole 22, and a slurry recycle means for recovering the discharged slurry into the vessel 26 for recycling.

The wafer chuck 16 for holding the wafer 10 is rotated by the first driving means 12 along the direction indicated by an arrow G in this CMP machine while vibrating along the direction indicated by an arrow H with the second driving means 13. The reciprocating movement means 19 electrically connected to the control device 21 allows the polishing pad holder 18 having a freely attachable and detachable polishing pad 11 to vertically reciprocate, repeating contact and non-contact between the polishing pad 11 and the wafer 10. The slurry discharge means 20 discharges the slurry 23 by a previously prescribed method through a small hole 22. The polishing pad 11 makes contact with the wafer 10 under an arbitrary pressure being previously stored in the control device 21, repeating contact and non-contact with an arbitrary time interval being previously stored in the control device 21. The control device 21 can also control the distance between the wafer 10 and the polishing pad 11. The third driving means 14 allows the polishing pad 11 to rotate along the direction indicated by an arrow I. The slurry 23 is accommodated in the vessel 26. The polishing pad 11 and the wafer 10 are positioned in the liquid of the slurry 23.

The fourth driving means 15 allows the polishing pad 11 to rotate along the direction indicated by an arrow J. Allowing the polishing pad 11 to rotate around the two different rotation axes as described above makes the polishing pad 11 rotate and revolve.

When the wafer 10 and the polishing pad 11 repeatedly make a contact and non-contact with each other, sufficient amount of the slurry is fed in the entire area between the wafer 10 and the polishing pad 11, making it possible to polish the wafer 10 without injuring it while maintaining a desired polishing rate in a given time interval. The polishing debris generated in the polishing process is prevented from being scattered in the vessel by suctioning and discharging the slurry 23 with the slurry discharge means 20 through the small hole 22.

The rotatory direction of the wafer 10 and the polishing pad 11 with the first, third and fourth driving means 12, 14 and 15 should be not necessarily along the direction indicated by the arrows, but their rotatory directions may be arbitrarily determined. In other words, it is preferable to reverse the rotatory and revolving directions with each other. The case where the wafer 10 is not rotated but only the polishing pad 11 is inversely rotated and revolved with each other, or the case where the polishing pad 11 is rotated to polish the wafer 10 rotating along the same direction are preferable. The driving means that are not required for the rotation of the first, third and fourth driving means may not be equipped on the polishing machine. It is no problem to freely determine the respective rotation speed. The rotation speed can be selected within a range of several rpm to several tens of thousands rpm. It was found from the detailed investigation by the inventors of the present invention that it is preferable to set the rotatory direction and rotation speed of the wafer 10 and the polishing pad 11 to the same direction and to the same speed with each other for making the polishing object face of the wafer flatter. It is especially preferable that the rotation speeds of the wafer 10 and the polishing pad 11 are the same as each other. It is also preferable that the rotatory and revolving speeds of the wafer 10 are the same as each other. It was found that the phenomenon in which the wafer 10 is adhered on the polishing pad 11 when the latter is removed from the former can be reduced if the rotation speed is set to a value more than a specified rotatory speed. This rotation speed is about 10 rpm or more.

The vertically reciprocating motion of the polishing pad 11 will be described hereinafter referring to the examples. Suppose that the time required for polishing the wafer 10 is 1 minute, then the polishing pad 11 repeats several times of non-contact with the wafer 10 within the time interval of about 1 minute. The time interval when the polishing pad 11 makes is in non contact with the wafer 10, or the difference between t2 and t1 is several seconds, being a time interval required for feeding a sufficient amount of the slurry on the entire polishing object face of the wafer 10. The distance f2 between the polishing pad 11 and the wafer 10 should be a distance which does not allow the rotating wafer 10 to jump out during the non-contact time, which is a distance smaller than the thickness of the wafer 10, actually being between 0.2 to 0.8 mm. Examples of the slurry discharge means 20 to discharge the slurry 23 through the small hole 22 include a method for continuously discharging the slurry 23 during the polishing process or a method for discharging the slurry only when the polishing pad 11 is not making contact with the wafer 10. While one of the parameters to be preferably determined in advance of the discharge of the slurry is the discharge pressure in discharging the slurry 23, it can be selected in a range that enables the constant acquisition of a required polishing rate and polishing object face.

The slurry 23 is discharged from the vessel 26 by the slurry discharge means 26. Since the amount of the slurry 23 in the vessel 26 is diminished by this discharge, the slurry 23 is supplemented when necessary.

The first method for supplementing the slurry 23 in the vessel 26 is to feed a fresh slurry in the vessel 26. The polishing debris is discharged out of the vessel 26 while feeding the fresh slurry not containing the polishing debris in the vessel 26. It is preferable that this method is adopted in precision polishing that requires a trace amount of the debris to be removed, being especially preferable for use in corrective polishing as described previously.

The second method involves a process in which the slurry once discharged from the vessel 26 by the slurry discharge means 20 is recovered by the slurry recycling means 27 and, after recovering a polishing ability sufficient for polishing the wafer 10 by adjusting the composition of the slurry 23, the slurry is recycled to the vessel 26. As a consequence, the amount of the slurry consumed in the polishing is reduced by several fractions as compared with the conventional methods.

The other method involves the supplementation of fresh slurry mixed with the slurry after recovering its polishing ability in the vessel 26. This method is also preferable in that the polishing debris in the vessel 26 can be removed along with reducing the consumption of the slurry.

A sufficient amount of the slurry 23 can be maintained in the vessel 26 by adopting any one of the foregoing methods. Since deterioration of the polishing ability of the slurry 23 can be alleviated by removing the polishing debris, a required polishing rate and polishing object face can be continuously obtained even when a plurality of wafers is continuously polished.

It is desirable that the cycle of the vertical motion of the polishing pad 11 and the space between the wafer 10 are determined so that the degree of polishing is within an objective value. The function of the vertical motion of the polishing pad 11 as a pump for distributing the slurry can be largely displayed by making the cycle of the vertical motion of the polishing pad 11 short or by making the travel distance of the polishing pad 11 long. The method according to the present invention can be applied for corrective polishing to polish the specified portion after specifying the portion of the polishing object face of the processing object that has been once polished. When the polishing pad is composed of a material having a large elastic modulus, the entire area of the wafer 10 is not always required to be in non-contact with the polishing pad 11 since a sufficient amount of the slurry can be distributed between the wafer 10 and the polishing pad 11 through a very narrow gap. Accordingly, the same function and effect as described previously can be obtained by repeatedly increasing and decreasing the pressure with time in making contact between the wafer 10 and the polishing pad 11. The same method as described above in the foregoing embodiment in which polishing is carried out by repeatedly making contact and non-contact between the wafer 10 and the polishing pad 11 can be also applied in the method for discharging the slurry 23 through the small hole 20 by the slurry discharge means 20.

It is preferable that the polishing pad holder of the polishing machine according to the present invention is so constructed as to have a large buoyancy.

Figure 6:
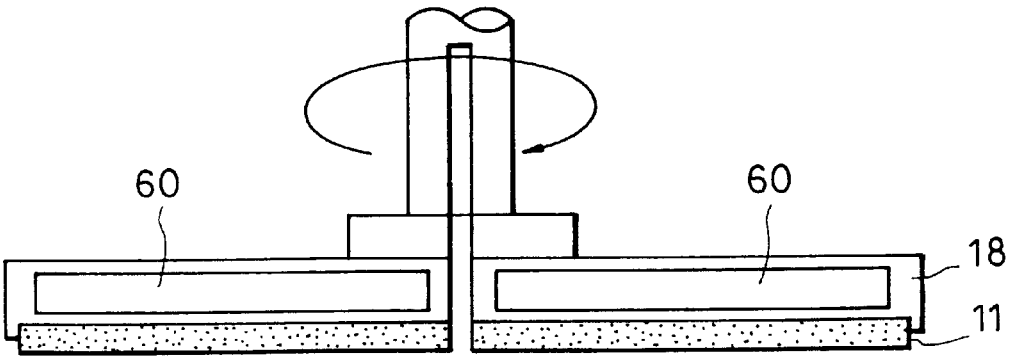
FIG. 6 is an illustrative drawing for describing another polishing pad holder according to the present invention.

In more detail, it is preferable to provide a cavity 60 inside of the polishing pad holder as shown in FIG. 6 to accommodate a material having a large buoyancy.

The material having a large buoyancy includes a material with a small density such as a wood, a foamed resin or a porous ceramic.

It is preferable that the polishing pad holder is so constructed as to hold the polishing pad flat along with being able to stably rotate at a high speed. It is preferable that the outside of the material with a large buoyancy is surrounded with, for example, a metal, a ceramic or a hard resin to prevent the polishing pad holder from being deformed.

It is preferable that a cavity 60 is provided to accommodate a gas such as air in the cavity 60 for increasing the substantial buoyancy of the polishing pad holder from the viewpoint of simplifying the construction of the polishing pad holder while obtaining a large buoyancy. Since the polishing pad holder is made to be lightweight in this case, the polishing pad holder can be easily rotated.

It is also made possible to rapidly and readily remove the polishing pad making contact with the polishing object during the polishing process from the polishing object by enhancing the substantial buoyancy of the polishing pad holder as described above.

A precise vertical motion can be obtained by using the polishing pad holder with a high buoyancy together with the reciprocating movement means.

The reciprocating movement means enhances the pressure so that the polishing pad held by the polishing pad holder with a high buoyancy is made to contact the polishing object. The mechanism for allowing the polishing pad holder to shift along the vertical direction in the device constituting the reciprocating movement means is simplified by a construction in which the polishing pad holder can float by itself when the pressure once enhanced by the reciprocating movement means is diminished.

Fifth Embodiment

Figure 7:
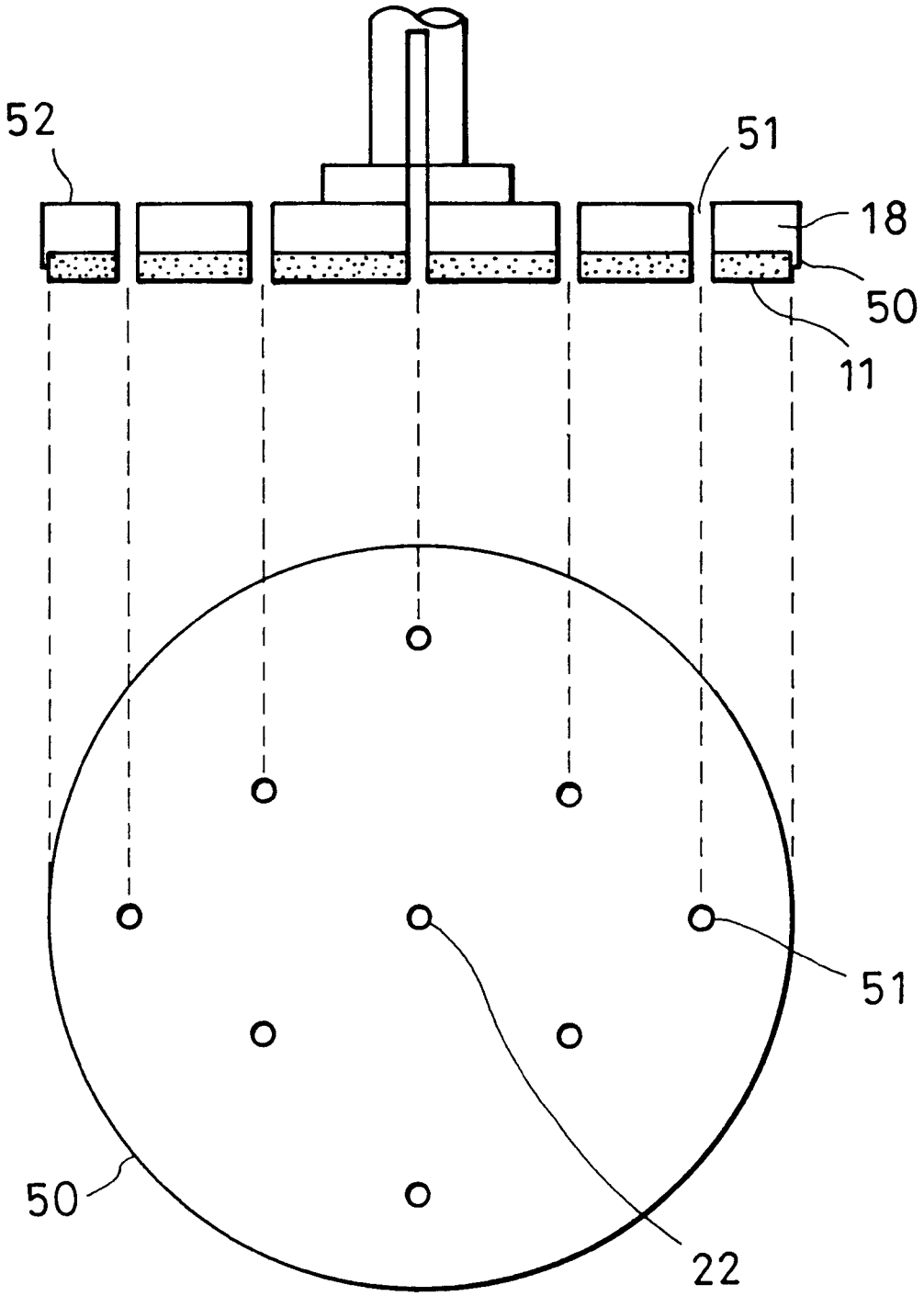
FIG. 7 is an illustrative drawing for describing the fifth embodiment of the present invention.
Figure 8:
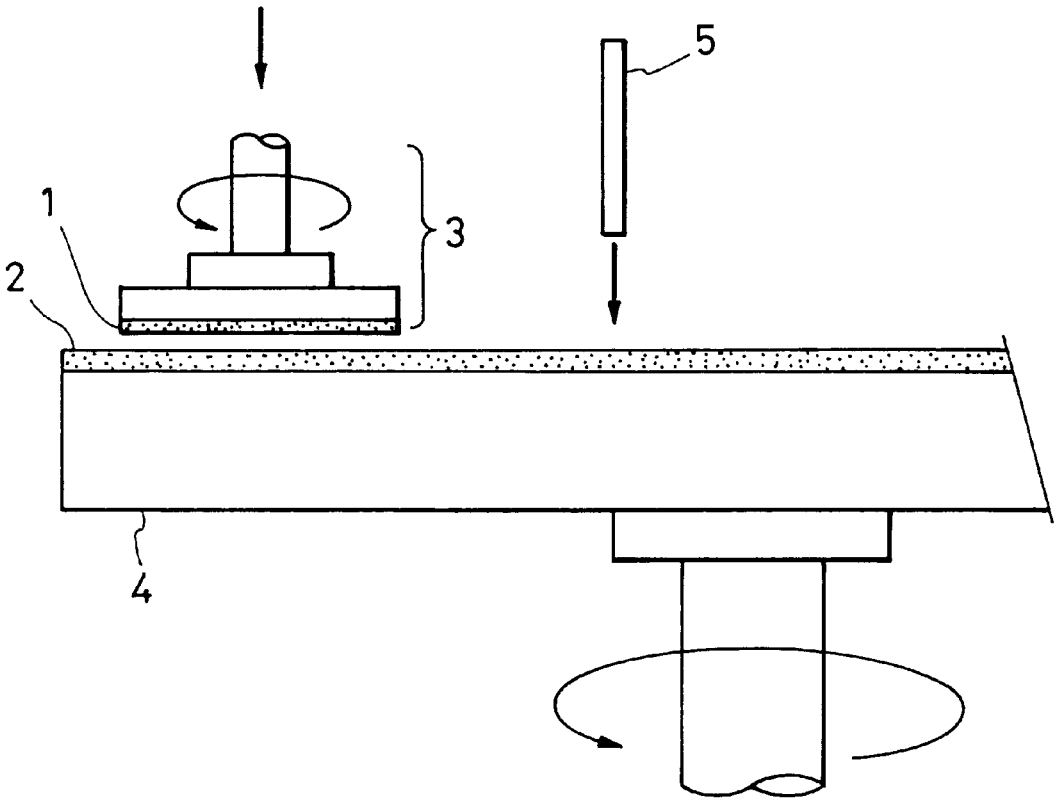
FIG. 8 is an illustrative drawing representing one aspect of the conventional chemical and mechanical polishing machine.
Figure 9:
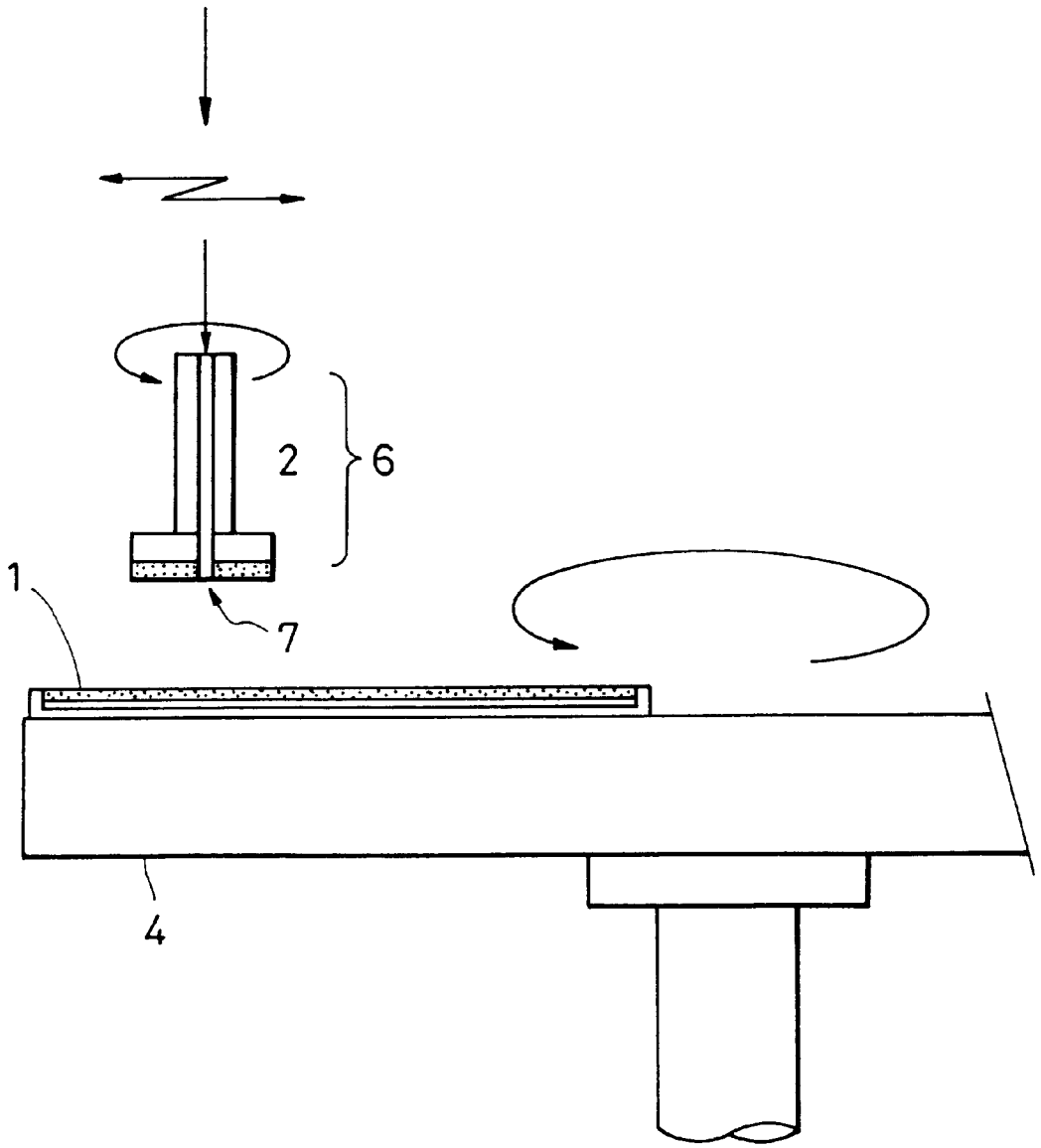
FIG. 9 is an illustrative drawing representing another aspect of the conventional chemical and mechanical polishing machine.

The fifth embodiment shown in FIG. 7 is characterized in that the polishing pad holder according to the first to fourth embodiments in the present invention has a penetrating hole.

FIG. 7 illustrates the polishing pad holder 18 according to the fifth embodiment of the present invention, wherein the top and bottom drawings represent the illustrative views of the polishing pad holder 18 along the side face and bottom face, respectively.

As shown in FIG. 7, the penetrating hole 51 has an opening on the holding face 50 for holding the polishing pad 11, the hole penetrating to the face 52 corresponding to the back face of the holding face.

The polishing agent, or a fluid, can be transferred from the holding face 50 to the face 52 corresponding to the back face via the penetrating hole 51 when the polishing pad 11 vertically moves. Consequently, the resistance force due to the liquid, or the resistance force acting to prevent the vertical motion of the polishing pad holder 18, is reduced so that the vertical motion of the polishing pad 11 is made easy.

A plurality of penetrating holes 51 are provided on the polishing pad holder 18 in a point symmetry relation with their center at the center of the holding face 50. A point symmetry disposition of a plurality of the penetrating holes 51 makes it possible to stably rotate the polishing pad holder 18 at a high speed.

It is preferable that holes aligned with the positions of the penetrating holes 51 are provided on the polishing pad 11. Since the polishing agent traveling through the penetrating holes can be easily diffused in or out between the polishing face of the polishing pad 11 and the polishing object face of the polishing object, it is made easy to feed the fresh polishing agent or to remove the polishing debris generated during the polishing or large insoluble substances from the gap.

The penetrating holes 51 may be so constructed, for example, as to penetrate from the holding face 50 to the side face of the polishing pad holder 18 in the polishing pad holder 18 according to the present invention besides being provided so as to penetrate from the holding face 50 holding the polishing pad to the face 52 corresponding to the back face of the holding face as shown in FIG. 7.

The penetrating holes 51 may be disposed at the arbitrary position provided that a uniform polishing of the polishing object is possible, besides the penetrating holes 51 are disposed in a point symmetry relation with their center at the center of the holding face 50.

According to the present invention, a sufficient amount of the polishing agent can be uniformly fed between the processing object and the polishing tool in the polishing machine in which the polishing agent is fed on the polishing object face of the processing object and the polishing object face of the processing object is polished with the polishing tool, because at least one of either the polishing tool or the polishing object is always positioned in the liquid of the polishing agent and polishing is carried out by repeating contact and non-contact between the processing object and the polishing tool while allowing the pressure to change. Consequently, polishing can be carried out without injuring the wafer while maintaining a stable polishing rate in a given time interval. The debris generated during the polishing process can be efficiently recovered, thereby enabling the reduction of production cost since an amount of the polishing agent not more than necessary may be fed. The polishing debris is prevented from being scattered in the air because the polishing debris generated during the polishing process is recovered in the liquid.

According to the present invention, a sufficient amount of the polishing agent can be uniformly fed between the processing object and the polishing tool in the polishing machine in which the polishing agent is fed on the polishing object face of the processing object and the polishing object face of the processing object is polished with the polishing tool along with enabling the efficient recovery of the polishing debris generated during the polishing process, because at least one of either the polishing tool or the polishing object is always positioned in the liquid of the polishing agent besides the polishing agent is suctioned and discharged through a small hole by the polishing agent discharge means connected to the small hole provided at the polishing tool. Consequently, polishing can be carried out without injuring the wafer while maintaining a stable polishing rate in a given time interval. The polishing debris is prevented from being scattered in the air because the polishing debris generated during the polishing process is recovered in the liquid.

What is claimed is:

1. A polishing machine comprising:

a holding means to hold an object to be processed;

a polishing tool;

a pressing means for allowing a face of said object to be processed to contact a polishing face of said polishing tool, both vertically confronting each other, by applying a given pressure;

a driving means for allowing at least one of said object to be processed and said polishing tool to rotate;

a vessel for accommodating a polishing agent; and a reciprocating movement means for allowing at least one of said object to be processed and said polishing tool to vertically reciprocate;

wherein said object to be processed and said polishing tool repeat contact and non-contact with each other in said polishing agent placed in said vessel to polish said face of said object to be processed with said polishing tool.

2. A polishing machine according to claim 1, wherein said vessel is composed of an alkali resistant material.

3. A polishing machine according to claim 1, wherein said vessel is composed of an acid resistant material.

4. A polishing machine according to claim 1, wherein said polishing tool is attached with said polishing face downward.

5. A polishing machine according to claim 1, wherein said polishing tool is attached with said polishing face upward.

6. A polishing machine according to claim 1, wherein said polishing tool polishes the entire face of said object to be processed.

7. A polishing machine according to claim 1, wherein said polishing tool polishes only a part of said face of said object to be processed.

8. A polishing machine according to claim 1, wherein said polishing face of said polishing tool is larger than said face of said object to be processed.

9. A polishing machine according to claim 1, wherein said face of said object to be processed has an approximately circular shape.

10. A polishing machine according to claim 9, wherein said face of said object to be processed has an approximately circular shape and the ratio of the diameter of said polishing face of said polishing tool to the diameter of said face of said object to be processed is in the range of 1 or more and less than 2.

11. A polishing machine according to claim 1, wherein said polishing face of said polishing tool is smaller than said face of said object to be processed.

12. A polishing machine according to claim 11, wherein at least two polishing tools are provided.

13. A polishing machine according to claim 1, wherein said driving means allows said polishing tool to rotate.

14. A polishing machine according to claim 13, wherein said driving means allows said polishing tool to revolve.

15. A polishing machine according to claim 1, wherein said driving means allows said holding means of said object to be processed to rotate.

16. A polishing machine according to claim 15, wherein said driving means allows said holding means of said object to be processed to revolve.

17. A polishing machine according to claim 1 having a swinging means to swing said polishing tool.

18. A polishing machine according to claim 1 having a swinging means to swing said object to be processed.

19. A polishing machine according to claim 1, wherein said reciprocating movement means allows either said polishing tool or said object to be processed to stand still while reciprocating the other.

20. A polishing machine according to claim 1, wherein said reciprocating movement means allows both of said polishing tool and said object to be processed to reciprocate.

21. A polishing machine according to claim 1, wherein said reciprocating movement means has at least one of pressure control means for either an elastic material or a fluid.

22. A polishing machine according to claim 1 being electrically connected to said reciprocating movement means, imparting electric signals to said reciprocating means, and having a control means for arbitrarily setting the distance between said face of said object to be processed and said polishing face of said polishing tool in a non-contact state.

23. A polishing machine according to claim 1 being electrically connected to said pressing means, imparting electric signals to said pressing means, and having a control means for arbitrarily setting the pressure for allowing said polishing tool to contact said object to be processed.

24. A polishing machine according to claim 1, wherein said polishing face of said polishing tool has small holes for connecting to a feed means of the polishing agent.

25. A polishing machine according to claim 1, wherein said polishing tool has a freely attachable and detachable polishing pad and a pad holder for holding the same.

26. A polishing machine according to claim 1, wherein said polishing tool has a cavity for increasing buoyancy in said polishing agent.

27. A polishing machine according to claim 1, wherein said polishing tool has a plurality of penetrating holes opening on a holding face to hold a polishing pad.

28. A polishing method for polishing a face of an object to be processed comprising the steps of:

rotating at least one of said object to be processed and a polishing tool;

contacting said face of said object to be processed with a polishing face of said polishing tool under a given pressure; and repeating contact and non-contact of said face of said object to be processed with said polishing face of said polishing tool in a polishing agent accommodated in a vessel, thereby polishing said face of said object to be processed.

29. A polishing method according to claim 28, wherein said object to be processed is any one of a semiconductor substrate, an insulating substrate provided on said face of said object to be processed or a semiconductor substrate provided with a polishing object layer.

30. A polishing method according to claim 28, wherein said polishing agent is composed only of fine particles.

31. A polishing method according to claim 30, wherein said fine particles contain at least one of silicone oxide, aluminum oxide and manganese oxide.

32. A polishing method according to claim 28, wherein said polishing agent is a liquid containing fine particles.

33. A polishing method according to claim 28 wherein after polishing the entire face of said object to be processed followed by specifying a portion to be polished, only said specified portion is polished again.

34. A polishing method according to claim 28, wherein said polishing tool has a cavity for increasing buoyancy in said polishing agent.

35. A polishing method according to claim 28, wherein said polishing tool has a plurality of penetrating holes opening on the holding face of the polishing pad.

36. A polishing machine comprising:

a holding means for holding an object to be processed;

a polishing tool;

a pressing means for allowing a face of said object to be processed to contact a polishing face of said polishing tool, both vertically confronting each other, by applying a given pressure;

a driving means for allowing at least one of said object to be processed and said polishing tool to rotate;

wherein said pressing means has a means for varying the pressure with a given cycle; and wherein said polishing tool polishes said face of said object to be processed by changing the pressure in a vessel accommodating a polishing agent.

37. A polishing machine according to claim 36, wherein said face of said object to be processed is composed of polyurethane.

38. A polishing machine according to claim 36, wherein said polishing tool has a cavity for increasing buoyancy in said polishing agent.

39. A polishing machine according to claim 36, wherein said polishing tool has a plurality of penetrating holes opening on a holding face for holding a polishing pad.

40. A polishing method for polishing a face of an object to be processed comprising the steps of:

rotating at least one of said object to be processed and a polishing tool;

contacting said face of said object to be processed with a polishing face of said polishing tool under a given pressure; and varying the pressure with a given cycle in a polishing agent accommodated in a vessel, thereby polishing said face of said object to be processed.

41. A polishing method according to claim 40, wherein polyurethane is used for said face of said object to be processed.

42. A polishing method according to claim 40, wherein said polishing tool has a cavity for increasing buoyancy in said polishing agent.

43. A polishing method according to claim 40, wherein said polishing tool has a plurality of penetrating holes opening on a holding face for holding a polishing pad.

44. A polishing machine comprising:

a holding means to hold an object to be processed;

a polishing tool having at least one hole at a polishing face;

a pressing means for allowing a face of said object to be processed to contact said polishing face of said polishing tool, both vertically confronting each other, by applying a given pressure;

a driving means for allowing at least one of said object to be processed and said polishing tool to rotate a vessel for accommodating a polishing agent;

a reciprocating movement means for allowing at least one of said object to be processed and said polishing tool to vertically reciprocate; and a polishing agent suction means connected to said at least one hole, said polishing agent suction means suctioning said polishing agent through said at least one hole.

45. A polishing machine according to claim 44, wherein said polishing agent suction means is connected to a polishing agent recycle means.

46. A polishing machine according to claim 44, wherein said vessel is composed of an alkali resistant material.

47. A polishing machine according to claim 44, wherein said vessel is composed of an acid resistant material.

48. A polishing machine according to claim 44, wherein said polishing tool is attached with said polishing face downward.

49. A polishing machine according to claim 44, wherein said polishing tool is attached with said polishing face upward.

50. A polishing machine according to claim 44, wherein said polishing tool polishes the entire face of said object to be processed.

51. A polishing machine according to claim 44, wherein said polishing tool polishes only a part of said face of said object to be processed.

52. A polishing machine according to claim 44, wherein said polishing face of said polishing tool is larger than said face of said object to be processed.

53. A polishing machine according to claim 44, wherein said face of said object to be processed has an approximately circular shape.

54. A polishing machine according to claim 53, wherein said face of said object to be processed has an approximately circular shape and the ratio of the diameter of said polishing face of said polishing tool to the diameter of said face of said object to be processed is in the range of 1 or more and less than 2.

55. A polishing machine according to claim 44, wherein said polishing face of said polishing tool is smaller than said face of said object to be processed.

56. A polishing machine according to claim 55, wherein at least two polishing tools are provided.

57. A polishing machine according to claim 44, wherein said driving means allows said polishing tool to rotate.

58. A polishing machine according to claim 57, wherein said driving means allows said polishing tool to revolve.

59. A polishing machine according to claim 44, wherein said driving means allows said holding means to rotate.

60. A polishing machine according to claim 59, wherein said driving means allows said holding means of said object to be processed to revolve.

61. A polishing machine according to claim 44 having a swinging means to swing said polishing tool.

62. A polishing machine according to claim 44 having a swinging means to swing said object to be processed.

63. A polishing machine according to claim 44, wherein said reciprocating movement means allows one of said polishing tool and said object to be processed to stand still while reciprocating the other.

64. A polishing machine according to claim 44, wherein said reciprocating movement means allows both of said polishing tool and said object to be processed to reciprocate.

65. A polishing machine according to claim 44, wherein said reciprocating movement means has at least one of pressure control means for either an elastic material or a fluid.

66. A polishing machine according to claim 44 being electrically connected to said reciprocating movement means, imparting signals to said means, and having a control means for arbitrarily setting the distance between said face of said object to be processed and said polishing face of said polishing tool in a non-contact state.

67. A polishing machine according to claim 44 being electrically connected to said pressing means, imparting electric signals to said pressing means, and having a control means for arbitrarily setting the pressure for allowing said polishing tool to contact said object to be processed.

68. A polishing machine according to claim 44, wherein said polishing tool has a freely attachable and detachable polishing pad and a pad holder for holding the same.

69. A polishing machine according to claim 44, wherein said object to be processed and said polishing tool repeat contact and non-contact with each other in said polishing agent placed in said vessel to polish said face of said object to be processed with said polishing tool.

70. A polishing machine according to claim 44, wherein said polishing tool has a cavity for increasing buoyancy in said polishing agent.

71. A polishing machine according to claim 44, wherein said polishing tool has a plurality of penetrating holes opening on a holding face for holding a polishing pad.

72. A polishing method for polishing a face of an object to be processed comprising the steps of:

rotating at least one of said object to be processed and a polishing tool having a hole at a polishing face thereof;

contacting said face of said object to be processed with said polishing face of said polishing tool under a given pressure; and suctioning polishing agent accommodated in a vessel from said hole with a polishing agent suction means, thereby polishing said face of said object to be processed.

73. A polishing method according to claim 72, wherein said suctioned polishing agent is recycled and accommodated in said vessel after recovering its polishing ability for polishing said face of said object to be processed.

74. A polishing method according to claim 72, wherein said object to be processed is any one of a semiconductor substrate, an insulating substrate provided on said face of said object to be processed and a semiconductor substrate provided on said face of said object to be processed.

75. A polishing method according to claim 72, wherein said polishing agent is composed only of fine particles.

76. A polishing method according to claim 75, wherein said fine particles contain at least one of silicone oxide, aluminum oxide and manganese oxide.

77. A polishing method according to claim 72, wherein said polishing agent is a liquid containing fine particles.

78. A polishing method according to claim 72 wherein, after polishing the entire face of said object to be processed followed by specifying a portion to be polished, only said specified portion is polished again.

79. A polishing method according to claim 72, wherein said object to be processed and said polishing tool repeat contact and non-contact with each other in said polishing agent placed in said vessel to polish said face of said object to be processed with said polishing tool.

80. A polishing method according to claim 72, wherein said polishing tool has a cavity for increasing buoyancy in said polishing agent.

81. A polishing method according to claim 72, wherein said polishing tool has a plurality of penetrating holes opening on a holding face for holding a polishing pad.

82. A polishing machine comprising:

a holding means to hold an object to be processed;

a polishing tool having a hole at a polishing face thereof;

a pressing means for allowing a face of said object to be processed to contact said polishing face of said polishing tool by vertically confronting said face of said object to be processed with said polishing face of said polishing tool under a given pressure;

a driving means for allowing at least one of said object to be processed and said polishing tool to rotate; and a polishing agent suction means connected to said hole;

wherein said pressing tool has a means for changing said pressure with a given cycle; and wherein said face of said object to be processed is polished with said polishing face of said polishing tool in a polishing agent accommodated in a vessel by suctioning said polishing agent from said hole by said polishing agent suction means.

83. A polishing machine according to claim 82, wherein a polishing agent discharge means is connected to a polishing agent recycle means.

84. A polishing machine according to claim 82, wherein said face of said object to be processed is composed of polyurethane.

85. A polishing machine according to claim 82, wherein said polishing tool has a cavity for increasing buoyancy in said polishing agent.

86. A polishing machine according to claim 82, wherein said polishing tool has a plurality of penetrating holes opening on a holding face for holding a polishing pad.

87. A polishing method for polishing a face of an object to be processed comprising the steps of:

rotating at least one of said object to be processed and a polishing tool having a hole on a polishing face of said polishing tool;

contacting said face of said object to be processed with said polishing face of said polishing tool under a given pressure;

varying said pressure with a given cycle; and suctioning a polishing agent accommodated in a vessel from said hole with a polishing agent suction means, thereby polishing said face of said object to be processed.

88. A polishing method according to claim 87, wherein said discharged polishing agent is recycled and accommodated in said vessel after recovering its polishing ability for polishing said face of said object to be processed.

89. A polishing method according to claim 87, wherein polyurethane is used for said face of said object to be processed.

90. A polishing method according to claim 87, wherein said polishing tool has a cavity for increasing buoyancy in said polishing agent.

91. A polishing method according to claim 87, wherein said polishing tool has a plurality of penetrating holes opening on a holding face for holding a polishing pad.

* * * * *

UNITED STATES PATENT AND TRADEMARK OFFICE

CERTIFICATE OF CORRECTION

PATENT NO. : 6,152,805
DATED : November 28, 2000
INVENTOR(S) : Kazuo Takahashi

It is certified that error appears in the above-identified patent and that said Letters Patent is hereby corrected as shown below:

Title page,
Item [56] FOREIGN PATENT DOCUMENTS
"363-185556 8/1988 Japan" should read -- 63-185556 8/1988 Japan --;
"402-256457 10/1990 Japan" should read -- 2-256457 10/1990 Japan --.

Item [57] ABSTRACT
"polishing" should read -- polished --.

Column 1,
Line 11, "profileration" should read -- proliferation --;
Line 66, "insufficient" should read -- an insufficient --;
Line 67, "of the" should read -- of -- and "is not" should read -- is --.

Column 2,
Line 52, "cost to" should read -- cost of --;
Line 53, "improve" should read -- improving --.

Column 3,
Line 2, "a short" should read -- short --;
Line 15, "to with contact with" should read -- to contact --;
Line 16, "with" should be deleted.

Column 5,
Line 28, "rotatory" should read -- rotary --;
Line 33, "polishes tool polishing" should read -- polishing tool polishes --.

Column 6,
Line 4, "rotatory" should read -- rotary --.

Column 7,
Line 57, "layer ." should read -- layer. --.

Column 8,
Line 47, "to with" should read -- to --;
Line 48, "with" should be deleted.

UNITED STATES PATENT AND TRADEMARK OFFICE

CERTIFICATE OF CORRECTION

PATENT NO. : 6,152,805
DATED : November 28, 2000
INVENTOR(S) : Kazuo Takahashi

It is certified that error appears in the above-identified patent and that said Letters Patent is hereby corrected as shown below:

Column 9,
Line 20, "sucking" should read -- suctioning --.

Column 10,
Line 26, "forgoing" should read -- foregoing --;
Lines 31 and 32, "course" should be deleted.

Column 11,
Lines 47 and 51, "rotatory" should read -- rotary --.

Column 12,
Line 36, "Alternatively" should read -- Alternatively, --.

Column 13,
Lines 57, 61 and 63, "rotatory" should read -- rotary --.

Column 14,
Line 13, "rotatory" should read -- rotary --.

Column 18,
Line 15, "wafer" should read -- the wafer --;
Line 16, "of the" should read -- of --.

Column 19,
Line 39, "make a" should read -- make -- and "sufficient" should read -- a sufficient --;
Lines 49, 52, 54 and 66, "rotatory" should read -- rotary --;
Line 51, "be not necessarily" should read -- not necessarily be --.

Column 20,
Lines 5 and 10, "rotatory" should read -- rotary --;
Line 18, "makes" should be deleted and "non contact" should read -- non-contact --.

Column 23,
Line 12, "agent besides" should read -- agent, besides, --.

UNITED STATES PATENT AND TRADEMARK OFFICE

CERTIFICATE OF CORRECTION

PATENT NO. : 6,152,805
DATED : November 28, 2000
INVENTOR(S) : Kazuo Takahashi

It is certified that error appears in the above-identified patent and that said Letters Patent is hereby corrected as shown below:

Column 25,
Line 11, "28 wherein" should read -- 28, wherein --.

Column 26,
Line 6, "rotate" should read -- rotate; --.

Column 27,
Line 57, "72 wherein" should read -- 72, wherein --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*